United States Patent [19]

Barsness et al.

[11] Patent Number: 4,556,044

[45] Date of Patent: Dec. 3, 1985

[54] WOOD AND COAL BURNING STOVE

[76] Inventors: Gerald H. Barsness, 4507 W. Ducharm, Peoria, Ill. 61607; Richard A. Kleine, 6017 Trenton La., Peoria, Ill. 61614

[21] Appl. No.: 390,028

[22] Filed: Jun. 18, 1982

[51] Int. Cl.[4] ..... F24C 1/14

[52] U.S. Cl. ..... 126/77; 126/146; 126/200; 126/67; 126/290

[58] Field of Search ..... 126/77, 112, 146, 163, 126/193, 200, 290, 67; 110/72

[56] References Cited

U.S. PATENT DOCUMENTS 844,342 2/1907 Fiebeger ..... 126/112

4,362,146 12/1982 Schuller ..... 126/77

*Primary Examiner*—William E. Lyddane

*Assistant Examiner*—Gerald A. Anderson

*Attorney, Agent, or Firm*—Clement and Ryan

[57] ABSTRACT

A stove for burning wood, coal and other fuels comprised of flammable solids that among other things produce one or more flammable gases when heating or burning. The preferred form of the stove has three modes of operation—a rapid burning mode, a normal or medium burning mode and a banked mode. The user makes a preliminary decision as to whether the stove is to be operated in its normal mode or banked mode. Thereafter, controlled by temperature responsive means, the stove moves itself fully automatically back and forth from the rapid burning mode to whichever one of the other two modes of operation has been preselected by the user.

49 Claims, 13 Drawing Figures

Fig. 3
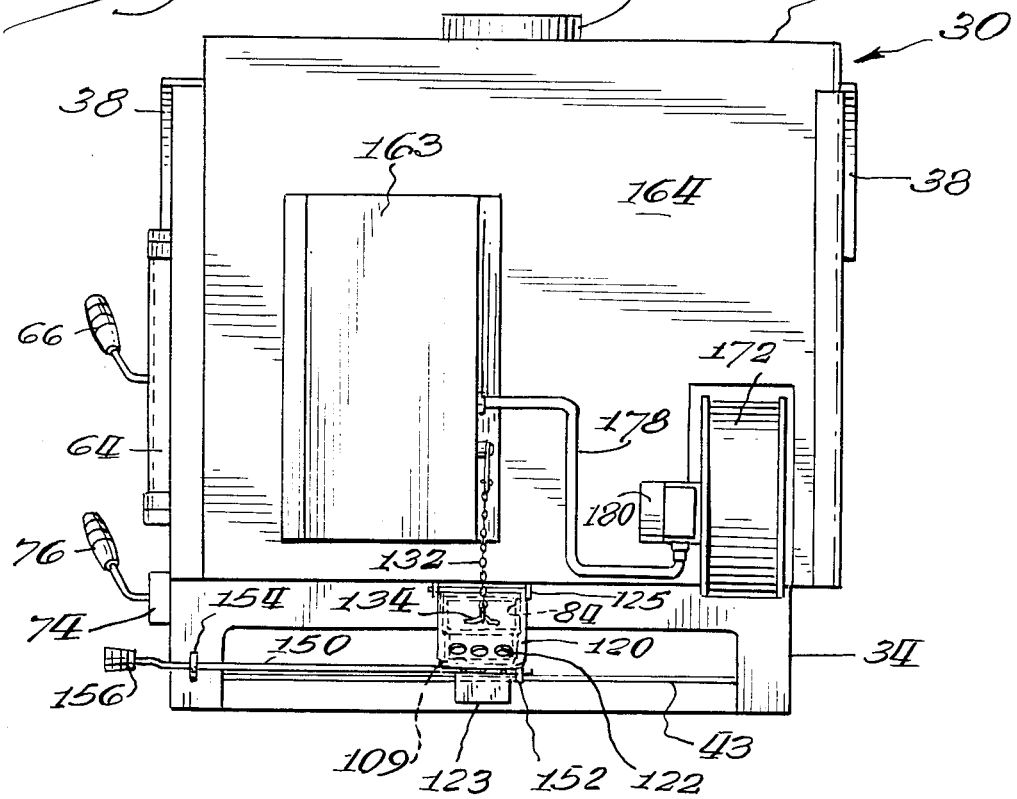
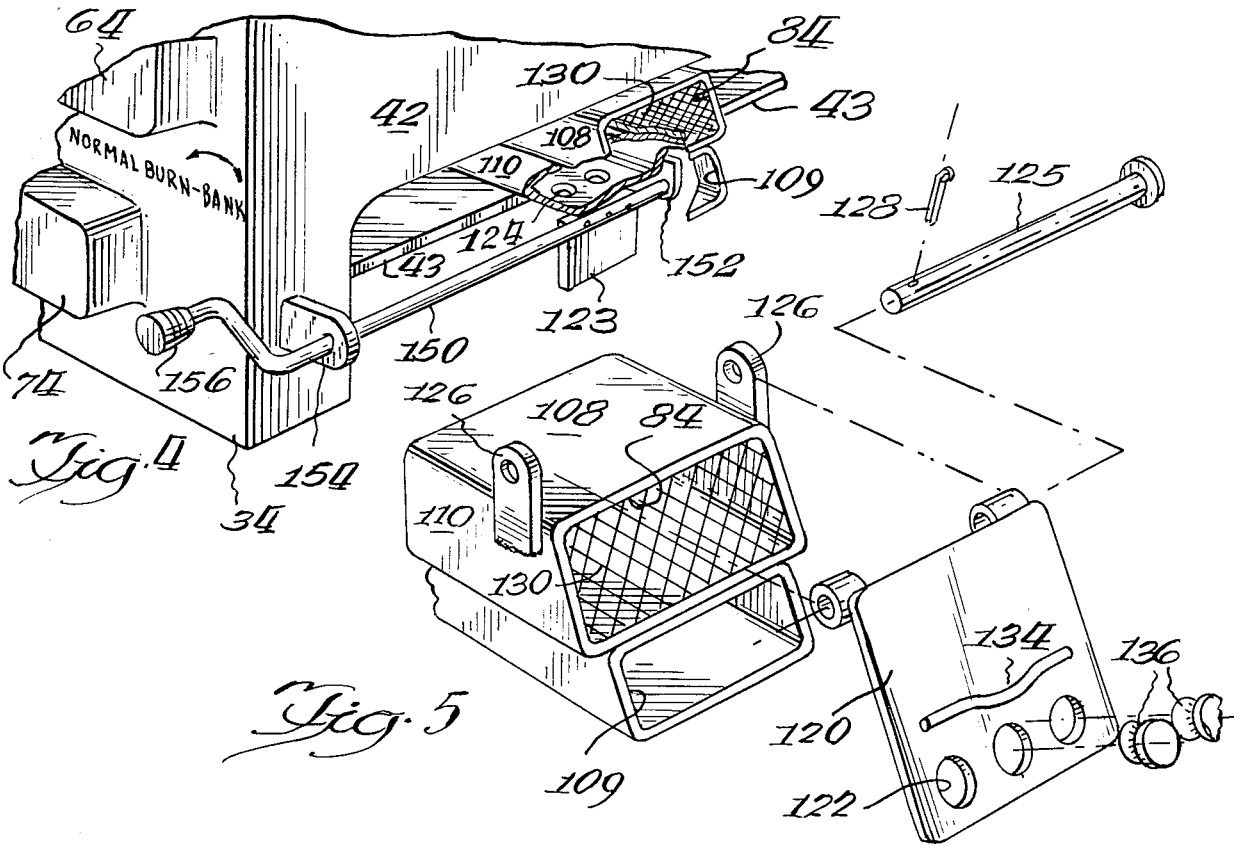
Fig. 4
Fig. 5

WOOD AND COAL BURNING STOVE

TECHNICAL FIELD

This invention relates to a stove for burning wood or any other solid fuel comprised of flammable solids that among other things produce one or more flammable gases when heated and burned, which stove is to be used as a space heater such as, for example, a radiant stove, a furnace add-on, a fireplace insert, or a heated air circulator, and more particularly such a stove that is capable of being moved wholly automatically by temperature responsive control means from a rapid burning mode of operation to either a medium burning mode or a banked mode, as selected by the user, and back again to the rapid burning mode.

BACKGROUND OF THE INVENTION

How The Combustion of Wood Proceeds

Firewood, one of the fuels for which the stove of this invention is designed, is composed of (a) solid flammable materials, and (b) other materials that are driven off from the fuel as flammable gases when the fuel is heated and burned during combustion. The stove of this invention is designed for efficient combustion of both types of fuel—flammable solids, and flammable gases driven off from the solid fuel during heating and combustion. Moreover, it is designed for fully automatic movement from a rapid burning mode of operation to a medium burning mode or a banked mode, as selected by the user, and back again to the rapid burning mode, in response to temperature responsive control means.

The constituents of wood include cellulosic materials, lignin, resin, oils, various extraneous materials such as tannin, and ash material. The process of combustion of these various constituents proceeds through four different temperature ranges. When the wood is first ignited, water is driven off as water vapor at about 200° to about 250° F. Pyrolysis of the wood—the chemical decomposition of the wood by the action of heat—proceeds in the temperature range of about 500° to about 750° F., producing charcoal, wood gas and wood oil vapors. The wood gas (containing carbon monoxide, methane, hydrogen, etc.) and the wood oil vapors ignite at about 1100° F. and above. Finally, at about 1200° to about 1800° F., the charcoal resulting from the pyrolysis of the wood combines with the oxygen of the air to form carbon dioxide and, if the oxidation process is not completed, carbon monoxide.

The steps of pyrolysis of the wood and the oxidation of the resulting charcoal are commonly referred to as constituting "primary combustion," and the burning of the flammable gases resulting from the heating and combustion of the wood, including wood gas and wood oil vapors, is commonly referred to as "secondary combustion." It will be seen that in fact these two types of combustion may take place either consecutively or simultaneously, and thus may be either separate or mixed phenomena.

Despite this fact, workers in this field sometimes speak as if the two phenomena are always wholly separate and distinct. The reason for this may be that air introduced for the main—though not the sole purpose—of supporting primary combustion is conveniently referred to as "primary air," while air introduced through a separate inlet for the main purpose—though sometimes not the sole purpose—of supporting secondary combustion is frequently for convenience referred to as "secondary air."

This terminology distinguishing between primary and secondary air is used (for reasons that will be apparent from the context) in certain places in this specification, although reference is sometimes made to "so-called" primary air and "so-called" secondary air in order to stress the fact that what is commonly called "primary air" practically always contributes to a limited extent to secondary combustion, and what is commonly called "secondary air" can—depending upon the level of its introduction into the fire chamber—contribute to a limited extent to primary combustion. In other contexts in this specification, the description of a particular source of air is given in terms of the level at which the air is introduced into the stove, rather than the type of combustion for which the air is primarily introduced.

Coal, whether hard or soft, is another fuel for which certain stoves constructed according to this invention are designed to be used. Both hard coal and soft coal, like firewood, are composed of (a) solid flammable materials, and (b) other materials that are driven off from the fuel as flammable gases when the fuel is heated and burned during combustion. Depending on the particular type of coal being used, varying amounts of carbon, volatile material (under which heating is driven off in the form of gas, water vapor, light oil and tar), and impurities such as sulfur, phosphorous and incombustible rock materials (which upon burning produce undesirable gases or ash) are included in the coal.

Because of its composition as just described, the burning of coal, as in the case of firewood, involves two steps which are commonly referred to as "primary combustion" and "secondary combustion." Hence the operation of the stove of this invention is similar whether it is designed exclusively for the burning of firewood or is designed for the burning of coal or other similar fuels as well.

Problem of Incomplete Combustion

For two reasons, a freely burning fire in an ordinary wood burning stove or fireplace can be easily recognized as being very inefficient.

First, the visual appearance of a wood fire in the ordinary stove or fireplace shows that neither the solid, flammable constituents of the wood nor the flammable gases driven off by the heating and burning of the wood are completely oxidized. The yellowish-orange flames that are characteristic of the usual freely burning fire in a wood burning stove or fireplace show immediately that the combustion is incomplete, since the color of the flames is brought about by the heating to incandescence of tiny suspended particles of carbon that result from the partial oxidation of the carbon-containing substances in the wood or in the flammable gases driven off from the wood. In addition, whenever a wood burning stove or fireplace gives off smoke, this again shows the presence of very small, cooler particles of carbon suspended in the air rising from the fire, and provides another sign of incomplete combustion.

Second, flue gases containing unburned carbon monoxide, methane, and other flammable gases can ordinarily be detected in quite considerable amounts rising from the usual wood burning stove or fireplace. This is of course still another sign of incomplete combustion.

Unless special attention is given to increasing the efficiency of a wood or coal burning stove, the incomplete combustion in such a stove will result in a severe loss of fuel heating power as the products resulting from the incompletely oxidized carbohydrate or carbonaceous matter and incompletely burned volatile matter pass out the stove flue. Several different approaches to solving this problem of incomplete combustion have been attempted in the past, but all of those approaches displayed serious shortcomings until the very effective results that were achieved through use of the apparatus disclosed and claimed in commonly assigned co-pending U.S. application for patent filed June 5, 1981 and assigned Ser. No. 270,885, now U.S. Pat. No. 4,469,083.

Among other things the invention of application Ser. No. 270,835 applies to the secondary combustion process in stoves that burn solid fuel such as firewood or coal a principle similar to the principle of carburetion that is employed in internal combustion engines. In the carburetor of a gasoline engine the incoming air is impregnated or charged in automatically controlled proportions with volatile carbon compounds in the form of tiny droplets of gasoline, while in the stove of the application referred to secondary air is mixed in automatically controlled proportions with the flammable gases that are driven off the solid fuel during heating and combustion of the fuel. An additional aspect of the mixing or "carburetion" process in such a stove is the control of the supply of flammable gases from the fuel that is effected indirectly through control of the amount of primary air that is provided for the combustion of the solid components of the fuel.

The control of the combustion process just described which is provided by the invention of U.S. Pat. No. 469,083 makes possible what may be characterized as at least a semi-automatic manner of operation. The present invention provides an improvement on the stove of that co-pending application, in that it makes possible a fully automatic manner of operation, after the basic decision has been made by the user as to whether the medium burning mode or banked mode of operation is desired, with a wholly balanced burn at all times in each of those two modes and, in addition, in the rapid burning mode of operation of the stove.

In contrast to the stove of this invention and the stove disclosed and claimed in U.S. Pat. No. 4,469,083, every prior stove of which applicants are aware had a general defect that made it inherently inefficient and unreliable to use: All such stoves have relied on experimentation by the user to find the most effective mode of operation and mix of primary and secondary air.

The experience, knowledge, and judgment of all users vary within wide limits, and the problem of selecting the best operating mode by experimentation is obviously complicated. The user will be able to select the proper size air inlet openings, if he can do it at all, only after considerable experience with a particular stove and extensive experimentation with various draft settings. This will require both a general knowledge of wood and coal burning stoves, and a particular familiarity with the individual stove being used. Reliance on experimentation by the user is thus clearly a poor expedient that inevitably gives haphazard and unreliable results.

If the draft setting or settings are too low, prior art stoves will generate creosote and smoke, which will obscure any viewing window that is included in the stove, and in every case will produce unwanted deposits on the interior walls of the stove and in the flue. Moreover, if the door or other cover for the fuel access opening is opened while the stove is generating a large amount of creosote and smoke, these materials will puff out into the room through the open door.

If the draft setting or settings are too high, the stove will fail to burn a large part of the flammable gases driven off from the fuel, and as a result a substantial amount of the heating value of the fuel will be wasted. Moreover, the fire in the stove may "run away" and grow much too hot; the top of a stove with such an improper setting has been known to grow actually red hot, with the characteristic cherry red color that indicates a temperature of about 1200° F.

The present invention solves both problems discussed above—the specific problem of incomplete combustion and the general problem of achieving the most effective burn—and accomplishes this fully automatically and with a balanced burn at all times.

SUMMARY OF THE INVENTION

The stove of this invention has at least two modes of operation. In its preferred form it has three modes which as already indicated may be referred to as a "rapid burning mode," a "medium burning mode" (sometimes also referred to as a "normal burning mode") and a "banked mode" of operation. The novel construction of this stove makes it possible for the stove to shift itself fully automatically, once the basic selection has been made by the user, back and forth between the rapid burning mode and whichever one of the medium burning mode and banked mode has been selected by the user, and to maintain a balanced burn in all modes of operation.

The stove is so constructed that after a freely burning fire has been established, with flames having the yellowish-orange color characteristic of incomplete combustion seen above at least a portion of the fuel being burned (the "rapid burning mode"), this mode of operation will continue if the stove does not become so hot that the controlling temperature (whether of the space being heated or of the stove itself) rises to the maximum temperature for which the thermostat (or other temperature responsive control) is set.

If the controlling temperature does rise to the thermostat maximum setting, and the stove has been previously programmed by the user to move into the "normal" or "medium burning mode" when that temperature is reached, the stove will automatically and by its own operation effect this change. This is accomplished when the so-called primary air inlet is automatically closed or otherwise reduced to its predetermined, fixed minimum air transmitting condition and the so-called secondary air metering means is automatically put in its medium air transmitting condition. With these two simultaneous changes, the fire converts itself into a bed of glowing coals with flickering blue and yellowish-blue flames above the coals, showing a highly efficient burning of the solid constituents of the fuel and also of the flammable gases driven off from the heated fuel.

The stove of this invention is preferably capable of still a third or "banked mode" of operation. If the user has previously selected this mode of operation and the temperature of the stove rises to the maximum temperature at which the thermostat has been set, the so-called primary air inlet opening is automatically closed or reduced to a predetermined, fixed minimum air transmitting condition and the amount of air introduced into the so-called secondary air inlet opening or openings is likewise reduced to a predetermined, fixed minimum. As a result of these automatic actions, the combustion of a bed of glowing hot coals and grayish red coals is sustained, but no substantial quantity of flames of any kind is visible above the pile of burning coals.

If the controlling temperature falls to a minimum thermostat setting after a period of automatic operation of the stove in the manner described in either the medium or banked mode operation previously selected by the user of the stove, the stove will automatically move itself back into the rapid burning mode in order to increase its output of heat. It accomplishes this by automatically re-opening the so-called primary and secondary air inlets to their predetermined, fixed maximum air transmitting conditions.

The stove of this invention will continue in this fully automatic manner of operation so long as sufficient fuel remains in the fire chamber of the stove, whether remaining from the original charge or replenished from time to time as required.

The stove operates in the manner described through temperature responsive control means that (1) places the air inlet means for so-called primary air and so-called secondary air in their respective maximum air transmitting conditions automatically and simultaneously in response to a predetermined minimum temperature, (2) places those air inlet means in air transmitting conditions less than their respective maximum air transmitting conditions simultaneously and automatically in response to a predetermined maximum temperature, and (3) always maintains an appropriate balance between the amounts of so-called primary air and so-called secondary air that are admitted to the stove.

In the present invention, the air inlet means for so-called primary air, has a finite plurality of predetermined, fixed air transmitting conditions and no other air transmitting conditions. Furthermore, once the user of the stove has positioned the selector knob of the thermostatic control for the main air inlet for so-called secondary air, and has made a selection as to which level of relatively low combustion (for example, the medium burning mode of operation or the banked mode of operation referred to above) is desired, the air metering means for so-called secondary air also has a finite plurality of predetermined, fixed air transmitting conditions and no other air transmitting conditions. The metering means for so-called secondary air has at least a maximum air transmitting condition and a medium air transmitting condition which is less than its maximum air transmitting condition, and preferably has a third air transmitting condition that is less than the medium condition. The air inlet means for so-called primary air has a maximum air transmitting condition and typically only one less-than-maximum condition, whether the latter condition is completely closed or permits the passage of a small amount of air.

In a preferred embodiment of the stove of this invention, before so-called secondary air is introduced into the fire chamber of the stove it flows through an air transmitting channel that (1) is several times (preferably more than three times) the length of the air transmitting channel through which so-called primary air flows, and (2) extends along the bottom and front walls of the stove and viewing box from back to front. This provides two advantages.

First, the secondary air is given a greater degree of preheating than when it is introduced directly into the stove or is channeled along only one vertical wall of the stove, one wall of the viewing box, or both, before being introduced into the fire chamber. Second, the inlet opening for so-called secondary air can then be located adjacent the inlet opening for so-called primary air, which facilitates the provision of means for controlling the input of the two types of air automatically and simultaneously for a balanced burn.

Introducing so-called primary air into the fire chamber after only a short run under the stove is feasible since it is more important to effect a higher degree of preheating of the secondary air, in order to avoid any chilling effect on flammable gases rising from the fuel being burned and which for greater efficiency must undergo secondary combustion, than it is to preheat primary air, which upon introduction into the fire chamber is exposed to the much higher temperatures of the burning solid material and is thus immediately and effectively raised in temperature.

In one embodiment of the stove of this invention, the means for the simultaneous adjustment of so-called primary air and so-called secondary air to achieve a balanced burn includes a main air flow gate that pivots from one position to another when actuated by a temperature responsive control means, moving between a maximum open position and a closed or otherwise less-than-maximum open position to provide automatic restriction or closure in a balanced way for both the so-called primary air and the so-called secondary air.

The gate plate in this embodiment defines three small circular apertures in that part of the plate that affects the opening for so-called secondary air, and the bottom wall of the secondary air transmitting channel defines two small, circular apertures. In one or another combination, these apertures make up the air inlet means for so-called secondary air in the medium burning mode and banked mode of operation, respectively, of the stove.

When the apertures in the bottom wall of the secondary air transmitting channel are open, these apertures, together with the apertures in the main air flow gate, constitute the controlled air inlet means (which may be augmented, as explained below, by a fixed supplementary secondary air inlet) for so-called secondary air for the medium burning mode of operation of the stove. When the apertures in the bottom wall of the secondary air transmitting channel are closed off, the apertures in the main air flow gate constitute the controlled inlet means for so-called secondary air in the banked mode of operation.

The user of the stove makes the decision as to whether the medium burning mode or the banked mode of operation is desired at any given time, and then either opens the apertures in the bottom wall of the air transmitting channel or closes them. Thereafter the stove automatically and simultaneously moves between the rapid burning mode and whichever one of the other modes of operation is preselected by the user, producing a balanced burn for each of the three possible modes of operation for the stove.

Other features of the stove of this invention provide still more advantages in the operation of the stove.

BRIEF DESCRIPTION OF THE DRAWINGS

In the drawings:

FIG. 3 is a rear elevation of the stove of FIG. 1;

FIG. 4 is an enlarged, fragmentary, three-quarters perspective view taken from the rear of the stove of FIG. 1, partially broken away and with the main air flow gate omitted for clarity;

FIG. 5 is a still further enlarged, exploded, perspective view of a portion of the stove shown in FIG. 4, including one embodiment of a main air flow gate for use in the stove of this invention designed for use primarily with firewood as fuel;

FIGS. 6 and 7 are fragmentary side elevations of further embodiments of main air flow gates for use in the stove of this invention designed to burn primarily firewood;

FIG. 10 is a view similar to FIG. 5 of another embodiment of a main air flow gate for use in a stove of this invention designed to burn either firewood or coal;

FIG. 11 is a fragmentary perspective view showing another embodiment of a main air flow gate for use in the stove of this invention designed to burn either firewood or coal;

DETAILED DESCRIPTION OF SEVERAL EMBODIMENTS

Figure 1:
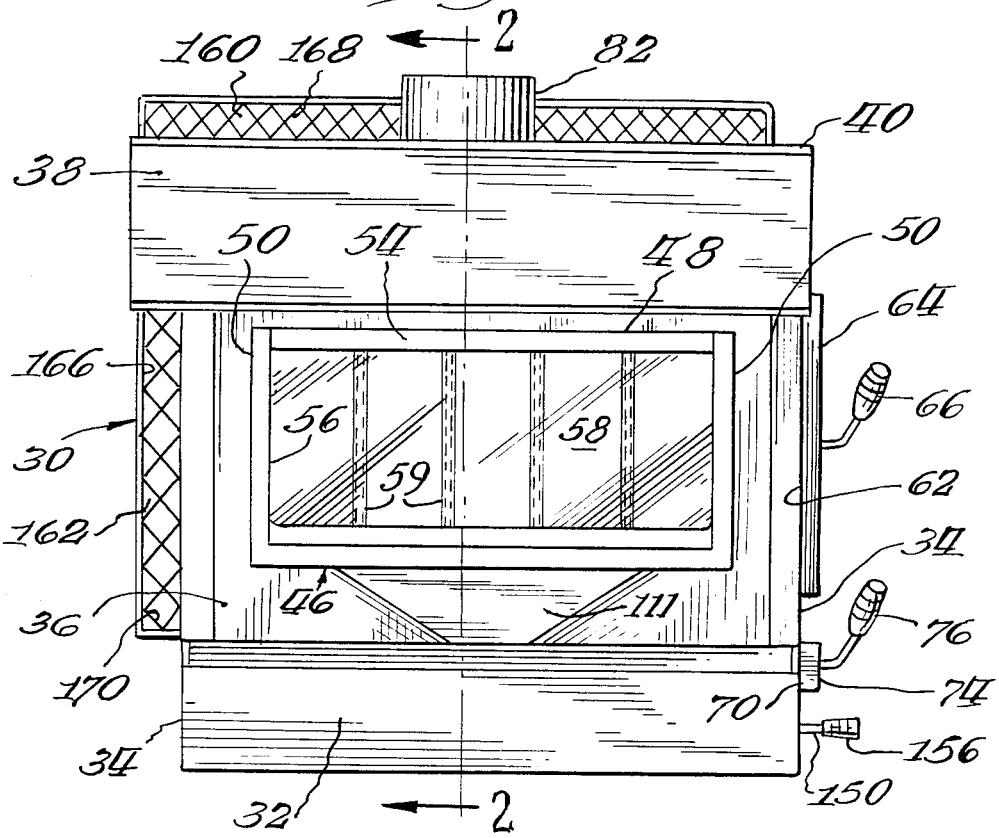
FIG. 1 is a front elevation view of one embodiment of the stove of this invention designed for use primarily with firewood as fuel.

It will be helpful to an understanding of the construction and operation of the stove of this invention if certain preliminary decisions to be made by the user of the stove are first discussed.

Decisions By User

The user of the stove of this invention must make four preliminary decisions as to the type of operation desired, and thereafter the operation of the stove is completely automatic. The first two of these decisions are long range decisions, while the last two decisions are short term decisions made from day to day and from time to time during any given day.

(1) Type of Fuel

The first decision, which will be made by the user to be followed for a relatively extended period of time, is a decision as to the type of fuel that will be burned in the stove. The main types of fuel with which the stove of this invention is designed to be used are firewood (whether hard or soft) and coal (whether hard or soft).

If the fuel used is firewood, the respective amounts of so-called primary air and so-called secondary air required will be roughly similar during the rapid burning mode of operation of the stove. When the stove is operated in its normal or medium mode, the so-called primary air can be cut off completely and the so-called secondary air reduced in amount. In the blanked mode of operation, the so-called secondary air can be reduced in amount still further, while the so-called primary air remains cut off entirely. These relationships obtained whether the firewood used is hardwood or softwood.

If the fuel to be used with the stove of this invention is soft coal, the quantities of so-called primary and so-called secondary air are again roughly similar during the rapid burning mode of operation of the stove. However, during the normal or medium mode of operation, a small amount of so-called primary air is required, with a somewhat reduced quantity of so-called secondary air. During the banked mode of operation with soft coal used as the fuel, either the same or a still smaller quantity of so-called primary air may be used but it is not cut off completely as when firewood is used as the fuel, and a further reduced quantity of so-called secondary air is employed.

When the fuel to be used is hard coal, the same general relationships prevail as when soft coal is to be used, except that a somewhat larger proportion of so-called primary air is used in both the medium and banked modes of operation of the stove.

(2) Ambient Conditions

The relative inlet openings for so-called primary and so-called secondary air to be employed with the stove of this invention depend also on the ambient conditions obtaining in the particular environment in which the stove is to be used. Under certain ambient conditions, the preferred openings for so-called secondary air that is introduced into the stove will be smaller than under other conditions. As will be explained below, the user of the stove must make a decision as to what is called for by these ambient conditions before the stove is put into use. Thereafter the operation of the stove will be completely automatic.

Generally speaking, if the user decides to use the stove under conditions that will increase the draw of the stove chimney, the velocity of the incoming air will also be increased, and smaller inlet openings for the air should be provided to maintain a well controlled burn in the medium burning mode and banked mode of operation. Use of the stove in a generally windy area, or at a low altitude above sea level, or with a higher than normal chimney will increase the draw of the chimney measured in terms of inches of water column. In such case, smaller inlet apertures for the so-called secondary air will be required. Changes in the course or length of the chimney may also increase the draw, and thus reduce the desired size of the inlet openings for the so-called secondary air.

Once the decision is made as to whether the generally prevailing ambient conditions in which the stove is to be used require smaller or larger inlet openings for so-called secondary air, those openings may be continued—with the stove operating itself fully automatically—without any changes or adjustments being necessary for day-to-day changes in wind, barometric pressure or temperature.

The only decisions to be made thereafter by the user of the stove are two day-to-day decisions that will now be discussed the mode of operation desired at any given time, and the particular temperature it is desired to maintain.

(3) Mode of Operation

The typical user of a wood or coal burning stove desires to use the stove in three quite different ways depending upon the occasion and the time of day:

1. The stove is sometimes used as a fireplace is used, to provide high, yellowish-orange, sometimes leaping, flames that have a soothing, almost hypnotic effect when an observer sitting in front of the fire watches the ever changing patterns of the flames. (The "rapid burning" mode of operation.)

2. When the stove is used principally for its heating effect during the day, a less vigorous and less picturesque but more economical type of fire, with the blue and yellowish-blue flames characteristic of a more efficient type of combustion, is desired. (The "medium" or "normal burning mode" of operation.)

3. When a lower level of heat for a longer duration is desired—as for example during the night—a still lower level of combustion is necessary. (The "banked mode" of operation.)

The stove of this invention makes possible all three of the described modes of operation on a fully automatic basis, once the basic decisions as to the desired mode of operation and desired temperature are made by the user.

(4) Temperature To Be Maintained

The final decision to be made from time to time during use of the stove of this invention is, of course, the temperature that is to be maintained so long as the original charge of fuel continues to burn or is replenished as required. This decision, as with a heating unit of any other type, is implemented by making the desired setting of the thermostat or other temperature responsive control means that is employed with the stove.

Figure 9:
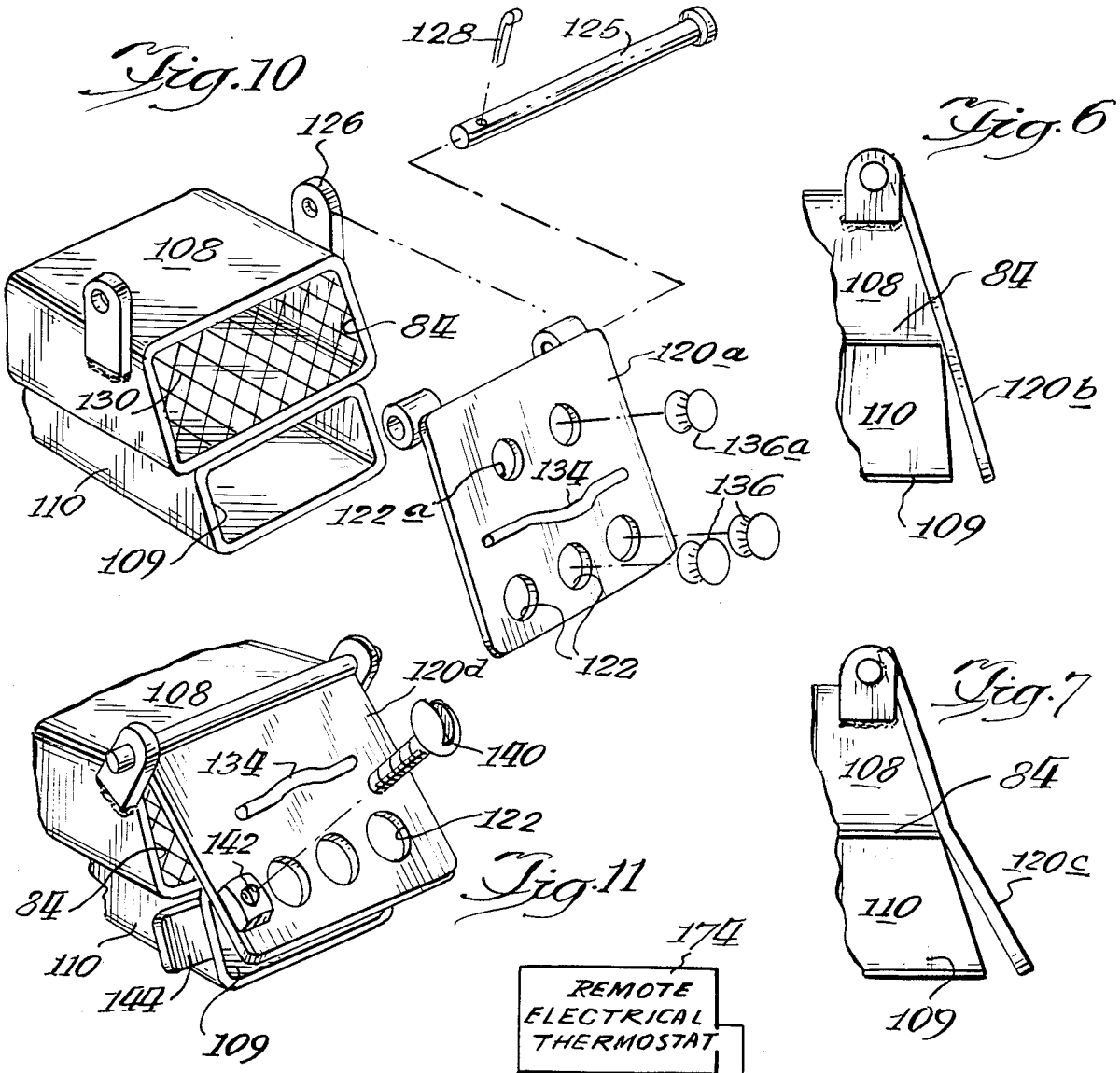
FIG. 9 is a diagrammatic showing of central means adapting any of the main air flow gates of FIGS. 5, 6 or 7 to another type of stove that provides a different method of fully automatic operation.
Figure 8:
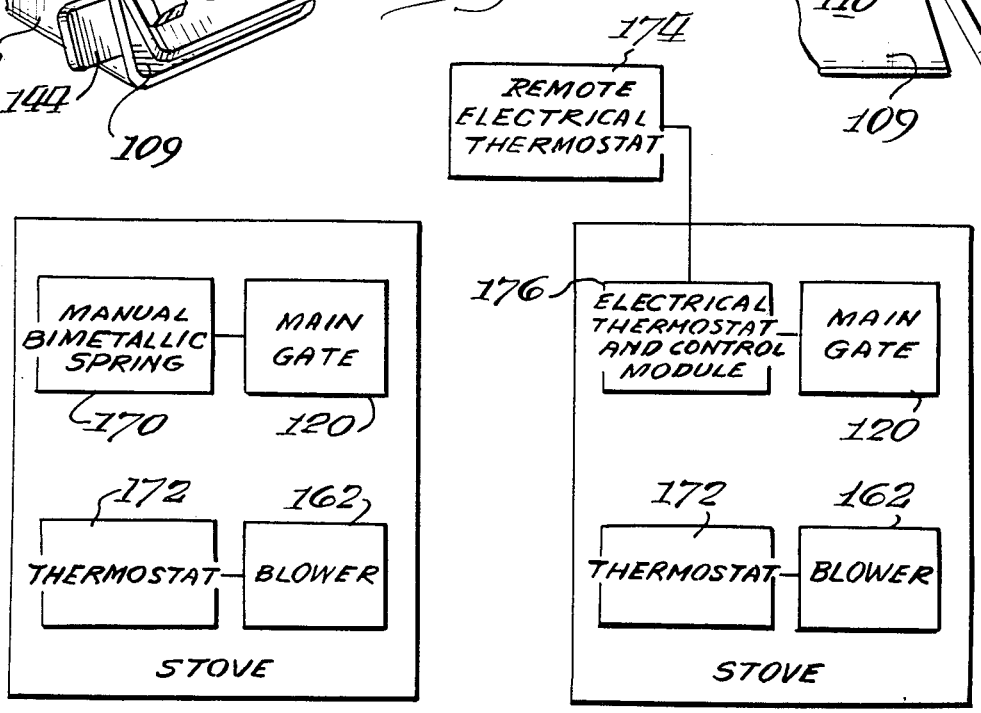
FIG. 8 is a diagrammatic showing of means for controlling the stove of this invention in one form of fully automatic operation that involves moving back and forth between a rapid burning mode and either a medium burning mode or a banked mode of operation.
Figure 12:
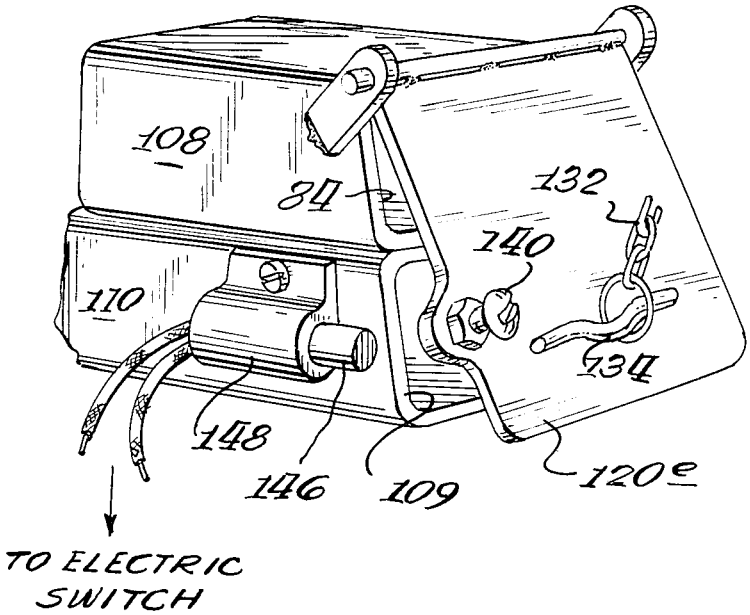
FIG. 12 is a fragmentary perspective view of another main air flow gate for use in a stove of this invention designed primarily for the burning of coal.
Figure 13:
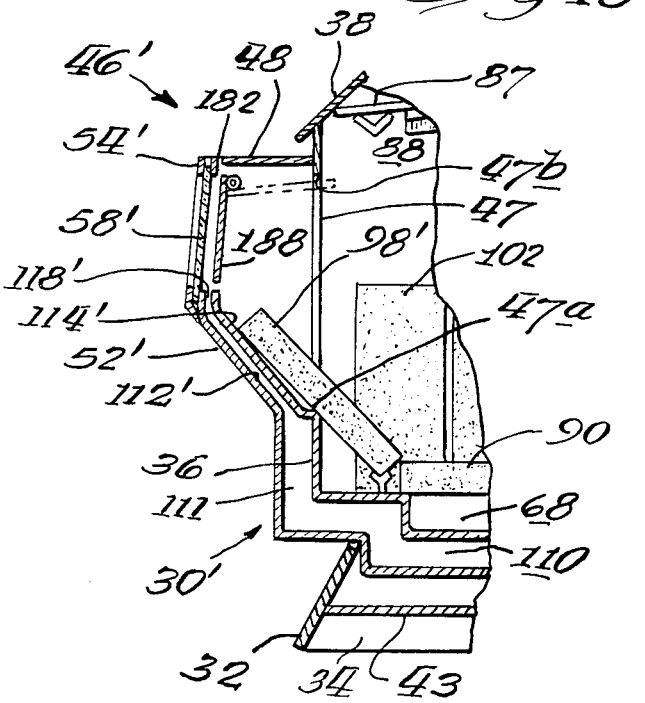
FIG. 13 is a fragmentary sectional view of a stove similar to the stove of FIG. 2, but specifically designed for burning coal as well as firewood.

Several embodiments of the stove of this invention will now be described in detail by reference to the accompanying drawings. FIGS. 1–5 illustrate one embodiment of the stove of this invention that is designed for use primarily with firewood as the fuel. FIGS. 6 and 7 show further embodiments of main air flow gates for use in the stove of this invention designed primarily for use with firewood. FIG. 9 is a diagrammatic showing of a special use with another type of stove of the main air flow gate that is a subcombination of the present invention. FIG. 8 is a diagrammatic showing of means for controlling the stove of this invention in its automatic operation. FIGS. 10 and 11 show main air flow gates for use in a stove of this invention designed to burn either firewood or coal, and FIG. 12 shows an embodiment of a main air flow gate for use primarily with coal. FIG. 13 shows a special construction for a stove to be used partially or wholly to burn coal.

The Stove Cabinet

Figure 2:
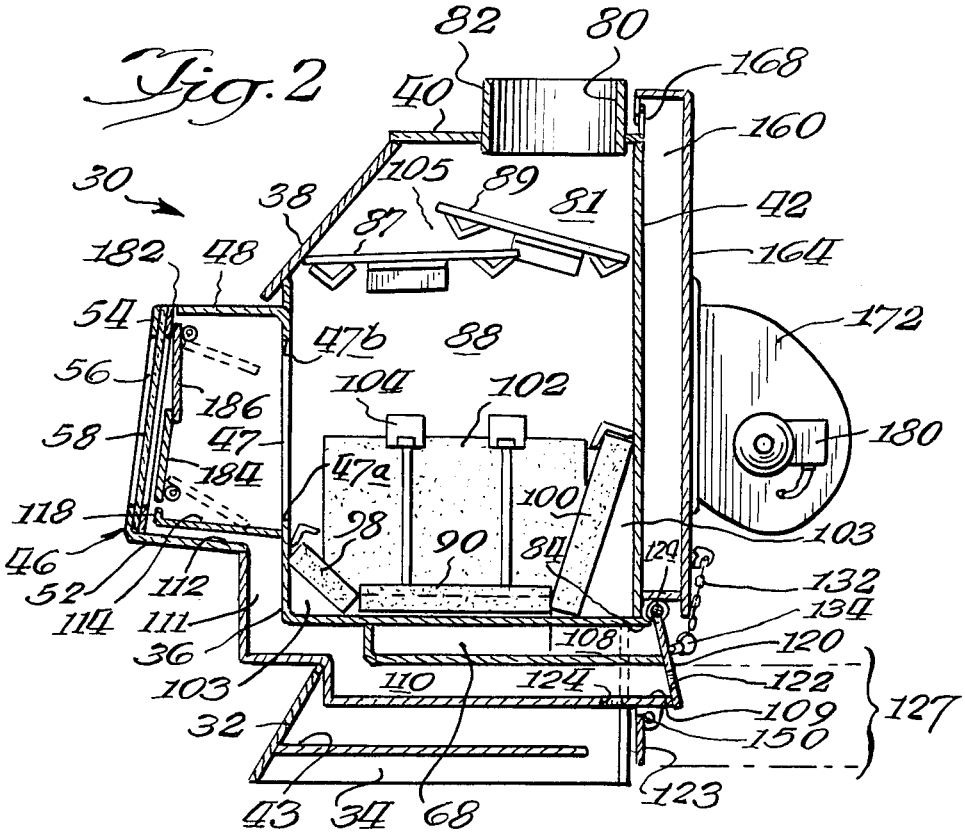
FIG. 2 is a cross sectional view of the stove of FIG. 1 taken along the line 2—2 in that FIGURE.

FIGS. 1–5 illustrate a wood and coal burning stove 30 constructed according to the principles of this invention. The stove includes cabinet 30 in which a fire grate, fire chamber, and ash pan (all to be described in more detail below) are located. Cabinet 30 includes base 32, a pair of end wall 34, front wall 36, sloping top wall 38, top wall 40, rear wall 42 and heat shield 43 (FIG. 2). The latter member helps provide protection for the floor upon which stove 30 rests against heat reflected downward from the stove.

In the embodiment shown, fire viewing box or chamber 46 extends forward from front wall 36 of cabinet 30 to provide a convenient way for the user of the stove to observe the wood fire burning in the fire chamber. As will be explained below, fire viewing box 46 communicates with the interior of the fire chamber through a large aperture or window 47—referred to hereinafter as the middle level air inlet opening—in front wall 36 of the cabinet (FIG. 2).

The viewing box includes top wall 48, end walls 50, bottom wall 52, and front wall 54. Opening 56 in front wall 54 accommodates planar, transparent viewing window 58. Guard posts 59 prevent large pieces of fuel from falling into viewing chamber 46.

Fuel access opening 62 for depositing pieces of solid fuel upon the interior fire grate is provided in the right-hand end of the stove shown in FIG. 1. This opening is closed during operation of the stove by hinged door 64, to produce a substantially airtight cover for the opening. Door 64 can be opened or closed by means of handle 66.

As shown in FIG. 2, ash collecting space 68 is located within the interior of stove cabinet 30 directly beneath the fire grate, which is at the bottom of the fire chamber. Ash removal opening 70, which communicates with ash colllecting space 68, is provided at the bottom of end wall 34 shown at the right-hand side of FIG. 1. Cover plate 74 is provided for this ash removal opening, to produce a substantially airtight closure for the opening. Cover plate 74 may be removed or pushed back into place, to open or close the ash removal opening, by means of handle 76. Handle 76 may also be used to pull the ash pan out from the interior of the stove cabinet when ashes are to be removed.

Exhaust leaving fire chamber 88 escapes from stove cabinet 30 through exhaust outlet opening 80 in top wall 40, which opening communicates with the top portion of the cabinet, exhaust space 81. Flue 82 conveys the exhaust from the stove, through opening 80, to a stack or chimney leading to the outside of the building in which the stove is located. A damper may be provided in flue 82 to reduce or substantially close off the flow of air or exhaust through the flue when this is desired.

As seen in FIG. 2, lower level air inlet means 84 (preferably, but not necessarily, a single opening) communicates with fire chamber 88 at the bottom of the chamber. Lower level air inlet opening 84 has predetermined, fixed maximum and minimum air transmitting conditions. The latter is a completely closed condition in the embodiment of FIGS. 1–5, which is designed primarily for use with firewood as the fuel. Except for any opening that may be present when lower air inlet opening 84 is in its minimum air transmitting condition, hinged cover 86 provides a substantially airtight closure of this opening.

Stove cabinet 30 as just described and any adjoining fire viewing chamber such as described below in this specification are of substantially airtight over-all construction, except for the openings (designated 62, 70, 80 and 84) just described, and the air metering means to be hereinafter described.

The Fire Chamber

As seen in FIG. 2, fire chamber 88 is defined by fire grate 90 at its bottom, generally vertical front wall 36, rear wall 42, and end walls 34, as well as an upper wall. In the embodiment shown, the upper wall is defined by sloping top wall 38 and baffle plates 87 and 89.

Upwardly extending front fire brick 98, rear fire brick 100, and fire brick 102 at the other end of the fire chamber 88 from fuel access opening 62 define the space in which pieces of wood to be burned in the stove are received. Brackets 104 hold generally upright fire bricks 98, 100 and 102 in place.

Baffle plate 87 is positioned to slant upward slightly from front to back, and baffle plate 89 to slant upward at a somewhat larger angle from back to front. This positioning of the baffle plates tends to deflect substantial portions of rising currents of gas and air from the burning fuel on the fire grate back into fire chamber 88. At the same time, opening 105 between the baffle plates permits the exhaust from the stove to pass upward out of the upper portion of file chamber 88 into exhaust space 81. The exhaust space lies between and communicates with fire chamber 88 and exhaust outlet opening 80.

Level of Air Inlet Openings

Lower level air inlet opening 84 communicates with ash collecting space 68, which is entirely below the bottom of fire chamber 88. This is the preferable location for introduction of so-called primary air into the fire chamber. It is not necessary in the stove of this invention that so-called primary air be introduced at this preferable level entirely below the bottom of the fire chamber, as in FIG. 2, but it is necessary that it be introduced at least somewhere adjacent the bottom of the fire chamber.

In any case, the path through which air flows from outside the stove into the lower level air inlet opening, and from there into the fire chamber, must be entirely separate from the path through which air flows from outside the stove into the fire chamber through the middle level air inlet opening or openings to be described below.

The positions of bottom edge 47*a* and top edge 47*b* of middle level air inlet opening 47 are determined by reference to the average height of fire chamber 88 measured from the fire grate at the bottom of the chamber to the upper wall at the top of the chamber. If desired, the positions of these edges may be determined in the manner described in U.S. Pat. No. 4,469,083, or in any other suitable manner.

Simultaneous Automatic Control Of Primary And Secondary Air Flow Into Fire Chamber Most of the features of the stove construction described thus far are conventional, although every feature described is not present in every prior art stove. The provision of a specially defined middle level air inlet opening or openings in addition to the lower level air inlet opening, the location and size of the various air inlet openings, the provision of air metering means having predetermined, fixed maximum and minimum air transmitting conditions for the middle level air inlet opening, and the arrangement of the elements of the stove cabinet and its fire viewing box to guide so-called secondary air through the lower portion of the middle level air inlet opening constitute important parts of the invention disclosed and claimed in co-pending application Ser. No. 270,835.

The stove of the present invention achieves surprisingly improved combustion efficiency by providing simultaneous, fully automatic control of both the so-called primary air and secondary air flow, once the user of the stove elects whether the stove is to move back and forth from a rapid burning mode of operation to its medium mode or to its banked mode. Moreover, the respective volumes of so-called primary air and secondary air, and the relative proportions of each, are selected in such a manner that whatever the mode of operation of a stove may be at any given moment, the introduction of air into the fire chamber proceeds in a manner to achieve maximum efficiency and combustion.

The fixing of the volumes and proportions of so-called primary and secondary air that are introduced into the stove can, if desired, be based upon the judgment and experience of one skilled in the construction of wood and coal burning stoves. However, it is preferred that the desired modes of operation of the stove be achieved through the use of either the observational method or the dimensional method of design disclosed and claimed in U.S. Pat. No. 4,469,083. (Specific examples of the application of the dimensional method of design to the construction of a stove having the simultaneous automatic control feature of the present invention are discussed below.)

In any event, the volume of air introduced into the fire chamber through both lower level air inlet 84 and middle level air inlet opening 47 is predetermined—at respective fixed values that are selected to give the most effective performance in the desired rapid mode, normal or medium mode, and banked mode of operation of the stove—by the designer of the stove rather than being left to the judgment and experience of the user based upon trial-and-error experimentation in the day-to-day operation of the stove.

Path For Primary Air

In the embodiment of FIGS. 1–5, so-called primary air enters aperture 84 and passes through air transmitting channel 108, around ash pan 68 and up through the spaces between fire brick 90 at the bottom of the fire grate. A moderate amount of preheating of the air takes place as it moves along the path described.

Low level inlet opening 84 has the smallest cross-sectional area of any portion of the path that is followed by incoming primary air as it moves through air transmitting channel 108 and around ash pan 68 up through the fire grate. For this reason, the cross-sectional area of inlet 84 determines the volume of so-called primary air flow from the exterior into fire chamber 88.

Path For Secondary Air

In the embodiment of FIGS. 1–5, so-called secondary air enters inlet aperture 109 and passes through air transmitting channel 110 extending along the bottom of primary air transmitting channel 108.

The bottom wall of channel 108 is integral with or in close contact with the top wall of channel 110, which causes some preheating of the secondary air as it enters upon its path toward middle level air inlet opening 47 leading into fire chamber 88. Further preheating occurs as the secondary air proceeds along passageway 110 until it reaches fan-shaped manifold 111, which is located in front of fire chamber front wall 36 and below the bottom wall 52 of viewing box 46. From the manifold the air passes through channel 112, defined by viewing box bottom wall 52 and upper wall 114, which comprises the bottom wall of the fire viewing chamber inside box 46. Air exits from channel 112 at the termination thereof through aperture 118.

Aperture 109 (as modified by main air flow gate 120 with its apertures 122), air transmitting channel 110 (as modified by apertures 124 and banked mode air flow gate 123), manifold 111, and channel 112 (with its terminal opening 118) determine the quantity of so-called secondary air that ultimately reaches middle level air inlet opening 47. The air passageway provided by members 109, 122 and 124 is of smaller cross-sectional size than members 111 and 112, and therefore imposes the ultimate limitation upon the quantity of secondary air entering the fire chamber. For this reason, members 109, 122 and 124 are designated as air metering means 127. As will be seen, this air metering means is in communication with the air surrounding the stove and with middle level air inlet opening 47 at all times.

The cross sectional area of air metering means 127 may, if desired, be increased by use of a supplementary secondary air inlet means such as slot 182 which is described below.

The air metering means just described, fuel access opening 62, ash removal opening 70, and lower level air inlet opening 84 all can be selectively opened or closed (or, where applicable, placed in their maximum or minimum air transmitting condition) independently of each other.

Main Air Flow Gate

The manner in which the volume of air flowing through primary air transmitting channel 108 and secondary air transmitting channel 110 is controlled by means of main air flow gate 120 and banked mode air flow gate 123 will now be described.

Aperture Control

In the embodiment of FIGS. 1–5, the control of primary and secondary air flow by means of gates 120 and 123 is accomplished through aperture control.

As best seen in FIG. 5, main air flow gate 120 is hinged on pintle 125 journaled in lugs 126 secured to the outer walls of primary air transmitting channel 108. Cotter pin 128 holds the hinge pintle in place. When in its lowest position, gate 120 closes off the outer end of primary air transmitting channel 108 completely, and also closes off the outer end of secondary air transmitting channel 110 completely except for metering apertures 122 in the lower portion of the gate.

In the embodiment shown in FIG. 5, primary air transmitting channel 108 is terminated in grill 130, to prevent any hot ashes or hot coals that may drop into channel 108 from fire chamber 88 from escaping to the outside. The effective cross-sectional areas of channels 108 and 110 are approximately the same, when allowance is made for the area occupied by the crossed wire of grill 130.

As is best seen in FIGS. 2 and 3, main air flow gate 120 is raised and lowered by chain 132, which is secured at its lower end to eye 134 carried by the gate. The actuation of chain 132 in the automatic operation of the stove of this invention will be explained below.

Apertures 122 in main air flow gate 120 are preferably circular, and three in number. Plugs 136, formed of any suitable material such as aluminum or other metal and of a size and shape to be snapped into apertures 122, are provided for the selective plugging of all but one of the apertures.

The decision as to whether to plug two, one or none of apertures 122 is made on the basis of the preliminary decisions by the user of the stove as to the type of fuel to be burned and the ambient conditions under which the stove will be used. As indicated above, under certain circumstances larger inlet openings for so-called secondary air will be desirable, and other circumstances smaller openings will be desirable.

Main air flow gate **122*a* in FIG. 10 includes two kinds of aperture control. Apertures 122 and plugs 136 provide means for controlling the amount of so-called secondary air that is admitted through air inlet opening 109. At the same time, when main air flow gate 120*a* is closed, apertures 122*a* and plugs 136*a* provide means for controlling the flow of so-called primary air into lower level air inlet means 84**.

This main air flow gate is useful when the fuel to be burned in the stove of this invention is coal, since as already pointed out above a measure of primary air is required for that fuel in order to keep the coal at an adequate level of burning during any medium burning mode or banked mode of operation of the stove.

Closure Control

FIGS. 6 and 7 are side elevation views of alternative embodiments of the main air flow gate by means of which air flow into lower level inlet means 84 for so-called primary air and inlet 109 for so-called secondary air can be controlled. In these embodiments, the closure of the gate and the inlet openings 84 and 109 is controlled, rather than providing the desired air flow through the use of apertures in the gate plate.

In FIG. 6, main air flow gate **120*b* is planar in construction, and a small gap is provided by the lack of closure of the edge of opening 109 with the gate plate. In FIG. 7, the edges of apertures 84 and 109 are planar in orientation, and the lower portion of main air flow gate 120*c* is bent outwards to provide a gap with the edge of opening 109** for so-called secondary air.

In both embodiments, the flow of so-called primary air into the stove is prevented when the main air flow gate is in the position shown in these two Figures. At the same time, a measure of secondary air is permitted to flow into the stove, as for example in the normal or medium mode of operation or in the banked mode.

FIGS. 11 and 12 show additional embodiments of closure control to put the main air flow gate in the desired position for the medium burning mode or banked mode of operation of the stove.

In FIG. 11, the position of main air flow gate **120*d* when it drops to its lowest position is determined by the extent to which set screw 40 is turned into threaded aperture 142 in the gate plate, which is decided by the user as a preliminary decision based on ambient conditions and the type of fuel to be used and is then left in that condition. Lug 144 provides a stop against which the lower end of set screw 140 comes to rest when main air flow gate 120*d* drops to its lowest position. In the embodiment of this Figure, apertures 122 provide for additional flow of so-called secondary air into opening 109 when the ambient conditions or the type of fuel used make this desirable. For this reason, main air flow gate 120*d*** may be considered as utilizing a combination of aperture control and closure control to determine the amount of so-called secondary air that is admitted into the stove.

In FIG. 12, main air flow gate **120*e* provides another embodiment that relies on closure control. In this embodiment, set screw 140 (which is set by the user's preliminary decision based on ambient conditions and the type of fuel to be used) comes into contact with plunger 146 of relay 148**, and the angle of the gate in its lowest position is determined by the setting of the plunger. This in turn is determined by the position of an electric switch which can be flipped by the user to select either a medium burning mode or banked mode of operation of the stove.

The embodiment of FIG. 12 is best adapted for inclusion in the stove of this invention when coal is the fuel to be used. As will be seen, whenever so-called secondary air is admitted through inlet opening 109 to air transmitting channel 110 because of the spacing between main air flow gate 120*e* and the edge of that opening, there will at the same time be approximately half as much space between the gate and the edge of lower level air inlet means 84. For this reason, so-called primary air will be admitted to the interior of the stove during any low level burning mode in which the stove is operated.

Banked Mode Air Flow Gate

As indicated above, air inlet opening 109, apertures 122 in main air flow gate 120 and apertures 124 in air transmitting channel 110 act cooperatively as air metering means 127. The manner in which apertures 124 cooperate as a part of air metering means 127 can be seen best from FIGS. 2–4.

FIGS. 2 and 4 illustrate how, when main air flow gate 120 is closed, apertures 124 in the bottom wall of secondary air transmitting channel 110 add their effect, when they are open, to that of apertures 122 in the gate plate. If all three apertures 122 are open, the cumulative effect of apertures 122 and 124 is to provide a total of five openings for the entry of so-called secondary air. If one or two plugs 136 are inserted in apertures 122, the cumulative effect of apertures 122 and 124 is to provide four or three openings, respectively. This quantity of so-called secondary air is sufficient for the medium or normal burning mode of operation of the stove, and the number of apertures left open will depend upon the ambient conditions in the environment in which the stove is operated.

To place the stove in its banked mode of operation, apertures 124 in secondary air transmitting channel 110 are closed off by banked mode air flow gate 123. Gate 123 is mounted on rod 150, which is journaled in flange 152 secured to secondary air transmitting channel 110 and flange 154 secured to rear wall 42 of stove 30. Control rod 150 may be rotated in the clockwise direction as one faces the stove by a movement of control knob 156, which places the stove in its banked mode of operation. Conversely, when apertures 124 are to be opened for the normal or medium burning mode of the stove, knob 130 is rotated in the counterclockwise direction, which opens apertures 124 again.

Preselector Means

It will be seen that in the embodiment of FIGS. 2–4 and 8, three elements comprise preselector means that can be employed by the user of the stove to select any of three predetermined, fixed air transmitting conditions of air metering means 127. These three elements that comprise the preselector means are:

1. Main air flow gate 120, as actuated by the temperature responsive control means that is comprised of thermostat 174 and the associated electrical control 176 in electrical control box 163;
2. Apertures 122 when gate 120 is closed; and
3. Apertures 124 as affected by the position of banked mode air flow gate 123 when gate 120 is closed.

It will be seen that in the embodiment under discussion air metering means 127 has a maximum air transmitting condition, a medium air transmitting condition, and a minimum air transmitting condition, which are predetermined, fixed conditions that are produced as follows:

1. When main air flow gate 120 is open because the temperature of the space being heated has not yet risen above the temperature at which the user of the stove has set the selector knob of thermostat 174, the maximum air transmitting condition is produced.
2. When gate 120 is closed but apertures 122 are open, and apertures 124 are open because the user of the stove has placed banked mode air flow gate 123 in its generally downwardly extending predetermined position, the medium air transmitting condition is produced.
3. When gate 120 is closed and apertures 122 are open, but apertures 124 are closed because the user has placed gate 123 in its horizontal predetermined position, the minimum air transmitting condition is produced.

It will also be seen that when gate 123 is in one of its two predetermined positions and main air flow gate 120 is either in its predetermined open or its predetermined closed position as a result of the setting of the selector knob on thermostat 174, air metering means 127 will have no other air transmitting conditions than its maximum, its medium, and its minimum air transmitting conditions as just described.

Finally, the portion of the preselector means being described that is represented by main air flow gate 120 (actuated as described above) determines which of the two predetermined air transmitting conditions of the first, lower level air inlet means is operative at any given time.

Air Transmitting Conditions Of Lower Level Air Inlet Means

As with the stove disclosed and claimed in U.S. Pat. No. 4,469,083, in the present invention the air transmitting condition of lower level air inlet means 84 through which so-called primary air is admitted to the stove is controlled with respect to the volume of fire chamber 88.

When the dimensional method of determining the size of lower level air inlet means 84 is used, lower level air inlet means 84 should provide a passage for unassisted air flow having the following cross-sectional areas in square inches for every cubic foot of volume of fire chamber 88, in order to achieve satisfactory, improved and preferred results, respectively, when the fuel used is as indicated:

TABLE I

| Mode Of Operation | PRIMARY AIR Results | | |
|---|---|---|---|
| | Satisfactory | Improved | Preferred |
| | Firewood | | |
| Rapid burning | 0.6–1.1 | 0.75–1.0 | 0.9 |
| Normal or medium | 0 | 0 | 0 |
| Banked | 0 | 0 | 0 |
| | Coal | | |
| Rapid burning | 0.6–1.1 | 0.75–1.0 | 0.9 |
| Normal or medium | 0.04–0.16 | 0.06–0.12 | 0.08 |
| Banked | 0.04–0.16 | 0.06–0.12 | 0.08 |

In determining the volume of fire chamber 88, it is necessary only to compute the approximate volume of the space within which combustion ordinarily takes place. This space is defined by the various physical elements that are located within stove cabinet 30 and by the plane of middle level air inlet opening 47 at the front of the fire chamber.

The longitudinal cross section of fire chamber 88 is substantially rectangular in shape, with the exception of the small volume occupied by end fire bricks 102. The lateral cross section of fire chamber 88, seen in FIG. 2, has the shape of an irregular polygon, outlined generally by fire grate 90, front fire bricks 98, the plane of middle level air inlet opening 47 and front wall 36, the lower half of sloping top wall 38, the space in front of baffle plate 89 and opening 105, the baffle plate itself, rear wall 42, and rear fire bricks 104. Dead spaces 103 are thus not included in the computation of the volume of the fire chamber.

Nor is the volume of viewing chamber 46 included in the computation, because that chamber merely acts as a reservoir, or pre-mixing zone, where air is being continuously introduced through air transmitting channel 112 (and slot 182 described below) and withdrawn to pass through middle level air inlet opening 47 into the fire chamber. Since the very hot flammable gases from the burning fire move straight up from the fire and remain entirely in fire chamber 88, with substantially no portion of these gases flowing into the viewing chamber, no oxygen is required for any combustion process in the latter space. Thus the space in question should not be included in any calculation that is intended to show the degree of richness in oxygen that is required to sustain combustion in the desired mode.

The figures given for the effective cross sectional area of lower level air inlet means 84 in relation to the volume of fire chamber 88 are specified for air being introduced under natural aspiration conditions, with the pressure difference that moves air into and through the metering means being unassisted by any mechanical propulsion means such as a blower fan. If a fan or other means for accelerating introduction of air into the stove is employed, an equivalent volume of air will be introduced with a smaller effective cross sectional area for the air passageway in question. The velocity of the incoming air will be increased, but the total volume of air will be the same.

The cross sectional area in square inches of lower level air inlet means 84 reflected in the above figures for the indicated ratios is the effective cross sectional area of the inlet opening. Thus, the area occupied by any obstacles such as grill 130 is subtracted from the cross sectional area that opening 84 would have if unobstructed. It will be seen from FIGS. 4, 5, 10 and 11 that when grill 130 is present the external dimensions of primary air transmitting channel 108 are greater than those of secondary air transmitting channel 110.

As indicated above in connection with the discussion of FIG. 10, when coal is the fuel used with the stove of this invention it is necessary—during operation of the stove in its medium or normal burning mode or banked mode—to have a small amount of so-called primary air introduced through lower level air inlet means 84 in order to maintain good combustion. It is preferred that only one aperture **122*a* in main air flow gate 120*a* be open when the stove is used under usual circumstances. For this reason, plug 136*a* is inserted in one of apertures 122*a* when stove 30 is used under ordinary conditions, and the figures in the above table for the burning of coal when the stove is in its normal or banked mode of operation are based on having only one aperture 122*a* open. If the ambient conditions indicate that a larger cross sectional area should be available for introduction of so-called primary air during the medium burning mode or banked mode of operation of the stove, this plug 136*a*** can be removed.

One example of a stove constructed according to the principles of this invention and having the dimensional relationships listed in Table I above is a stove in which the volume of fire chamber 88 is about 3.85 cubic feet, the effective cross-sectional area of lower level air inlet means 84 is about 3.5 square inches, and main air flow gate **120*a* (as in FIG. 10) has an aperture 122*a*** (that is left open) with a cross-sectional area of about 0.3 square inches.

Air Transmitting Conditions Of Air Metering Means For Secondary Air

If desired, the cross-sectional area of air metering means 127 (which as explained above is basically composed of opening 109 and apertures 122 and 124), may be increased by providing an additional opening or openings for introduction of so-called secondary air into fire chamber 88. Any such supplemental secondary air inlet means should not introduce too much air into the fire chamber or at too high a level.

An example of such a supplemental air inlet means is shown in FIG. 2 as narrow slot 182 at the forward end of upper wall 48 of viewing box 46. With a stove of this invention which has a fire chamber volume of 3.85 cu. ft., slot 182 is about 3/16 inch wide and about 22 inches long, making its cross-sectional area approximately one square inch.

The principal advantage of slot 182 is that it will remain open even if apertures 124 are closed by rotating banked air flow gate 123 into place, main air flow gate 120 is closed, and all apertures 122 are accidentally closed. With some air always available through slot 182, sufficient secondary air will be provided that the fire in chamber 88 will not be reduced in efficiency to the point where a large quantity of carbon monoxide might accumulate because of ineffective combustion, which would of course produce a potentially explosive situation when door 64 is opened to permit additional fuel to be added to the fire through fuel access opening 62.

The air transmitting condition of air metering means 127 through which so-called secondary air is admitted to the stove is, again, controlled in the present invention with respect to the volume of fire chamber 88 in a manner similar to the stove disclosed and claimed in U.S. Pat. No. 4,469,083.

When the dimensional method of determining the size of air metering means 127 and any supplementary secondary air metering means is used, a passage for unassisted air flow should be provided having the following cross-sectional area in square inches for every cubic foot of volume of fire chamber 88, in order to achieve satisfactory, improved or preferred results, respectively, when the fuel used is either firewood or coal:

TABLE II

| Mode Of Operation | SECONDARY AIR Results | | |
|---|---|---|---|
| | Satisfactory | Improved | Preferred |
| | Firewood Or Coal | | |
| Rapid burning | 1.0–1.35 | 1.17–1.3 | 1.25 |
| Normal or medium | 0.5–0.65 | 0.55–0.63 | 0.6 |

TABLE II-continued

| Mode Of Operation | SECONDARY AIR Results | | |
|---|---|---|---|
| | Satisfactory | Improved | Preferred |
| Banked | 0.3–0.5 | 0.35–0.45 | 0.4 |

The effective cross-sectional area of any supplemental secondary air inlet means such as slot 182 that is present in the stove must be added to that of inlet aperture 109 in computing the total cross-sectional area of the means (wherever located) that meters the flow of so-called secondary air into the chamber 88. This has been done in making the determinations recorded in Table II above.

One example of a stove constructed according to the principles of the present invention in the design of which the figures included in Table II are followed is a stove in which the volume of fire chamber 88 is about 3.85 cubic feet, the cross-sectional area of the main inlet aperture 109 is about 3.8 square inches, two circular apertures 122 of cross-sectional areas of about 0.3 square inches each are included (and are not plugged) in main air flow gate 120, two circular apertures 124 of cross-sectional area about 0.3 square inches each are included in the bottom wall of air transmitting channel 109, and the cross-sectional area of slot 182 is about 1 square inch. These dimensions make the total cross-sectional areas of the means that monitor the introduction of so-called secondary air into the fire chamber 4.8 square inches during the rapid burning mode, 2.2 square inches during the normal burning mode, and 1.6 square inches during the banked mode of operation.

In selecting appropriate figures from Table I and Table II above for the design of a stove constructed according to the present invention, figures at the lower end of the indicated ranges for the ratios in question for lower level air inlet means 84, or figures at the upper end of the ranges for the indicated ratios for inlet aperture 109, will be preferred if the construction of secondary air transmitting channel 110 tends to make the velocity of the air moving through that passage slower than the velocity of the air moving through primary air transmitting channel 108.

With stoves constructed according to the disclosure of co-pending application Ser. No. 270,835 (now U.S. Pat. No. 4,469,083), for example, the velocities with which so-called primary air and so-called secondary air move into the stove will be likely to be very nearly the same, since the lengths of the respective passageways through which the air flows are about the same. On the other hand, with the stove of FIG. 2 of the present application, the velocity of the so-called secondary air will tend to be less than that of the so-called primary air, for the reason that air passageway 110 (as will be seen from FIG. 2) is several times longer than air passageway 108, and is not straight but includes several bends. In addition, the passage of air through apertures 122 (when main air flow gate 120 is closed) and apertures 124 will tend to decrease the velocity of air entering passageway 110 through those inlets, both because of the circular form of the apertures and because of the orientation of apertures 124 transverse to the line of flow through passageway 110. These tendencies to reduce the velocity of the so-called secondary air in passageway 110 may be counteracted to an extent by the increased preheating of the air because of its longer passage under the bottom of the stove.

Inclusion of three apertures 122 in main air flow gate 120, as shown in FIG. 5, is advantageous. One of the apertures can then be closed off with plug 136, and the other two apertures left open for operation of the stove of this invention under typical conditions. If ambient conditions are such that the draw in the stove is increased above the draw that is present in the usual operation of such a stove, the user of the stove may make a preliminary decision such as described above to close off a second aperture with plug 136. On the other hand, if ambient conditions seem to require the use of a third aperture 122, the plug 136 that was inserted in one of apertures 122 can be removed. This construction provides, as will be seen, a high degree of flexibility in the operation of this stove, while the principles of the invention still apply.

Air Circulating Means

The stove of FIGS. 1–5 is provided with air circulating means at the rear and top of the stove, and at the left-hand side as seen in FIG. 1. Air heating passageway 160 is located at the rear of fire chamber 88, where heat from the fire chamber passes through rear wall 42. Air heating passageway 162 lies at one end of fire chamber 88, where heat passes through end wall 34.

Rear air heating passageway 160 is defined by rear shroud 164, and side air heating passageway 162 is defined by shroud 166. These passageways have no fluid communication with fire chamber 88. Air is admitted into the passageways through an opening (not shown) in shroud 164, to absorb heat from rear wall 42 and end wall 34 of fire chamber 88. The air in its resulting heated condition is discharged from passageway 162 at its outer end. The discharge ends of passageways 160 and 162 are provided with grills 168 and 170, respectively.

Air is moved into air passageways 160 and 162 to be heated there, and then blown outward from stove cabinet 30, by mechanical blower fan 172, the operation of which is controlled (as explained in the next section of this specification) by a thermostat responsive to the temperature of the stove.

Automatic Operation of Stove

As already pointed out above, a critically important feature of the present invention is the fully automatic moving of the stove back and forth from its rapid burning mode to whichever one of the medium burning mode or banked mode of operation has been selected by the user, accompanied by the balancing of flow of so-called primary and so-called secondary air. This may be in response to the temperature of the space being heated or the temperature of the stove itself, as desired.

FIG. 8 gives a diagrammatic showing of an arrangement for operation of main air flow gate 120. In this embodiment, two electrical thermostats 174 and 176 are connected in series, to control the operation of the gate. Thermostat 174 may be a low limit, bimetallic, wall mounted thermostat that can be manually set to a desired temperature such as, for example, 68° F. When the temperature of the room or other space to be heated falls below 68° F., the thermostat will be actuated to close the electrical circuit controlled by it and thereby put that circuit in condition to open gate 120. By the same token, when the ambient temperature rises somewhat above the thermostat setting, the thermostat will no longer actuate the electrical circuit controlled by it and gate 120 will therefore (as is apparent from FIGS. 2–3) be closed by force of gravity.

Thermostat 176 may be a high limit electrical thermostat mounted on the interior wall of either rear shroud 164 or side shroud 166. Normally conductive, this thermostat may be adapted to open the electrical circuit that controls gate 120 when the temperature of the heated air from the stove rises to 160° F. or higher.

The electrical controls that are actuated by the thermostats as just described are contained in electrical control box 163. As shown in FIG. 3, main air flow gate 120 is connected by means of chain 132 to electrical control box 163 and cable 178 connects control box 163 electrically with electric motor 180, which drives blower fan 172.

As will be seen, the interaction of thermostats 174 and 176 causes gate 120 to open when the temperature in the space to be heated drops below the temperature at which thermostat 174 is set, and keeps gate 120 open so long as the temperature of the room or other space being heated not rise appreciably above the temperature at which thermostat 174 is set or the temperature of the heated air leaving the stove to enter the space being heated does not rise above 160° F.

The automatic, simultaneous changing of the level of flow of both so-called primary and so-called secondary air is critical to this invention. With simultaneous adjustment of the quantity of each type of air flowing into the stove, a balanced burn is achieved at all times. Thus, when the stove is caused by its temperature responsive control to move, for example, from its banked mode of operation to its rapid burning mode, sufficient so-called secondary air will be automatically introduced into fire chamber 88 to produce adequate secondary combustion in the rapid burning mode. In this manner the loss of any large quantity of gases that are driven off the burning wood or coal but do not find sufficient secondary air available to complete their combustion will be avoided. If the supply of secondary air was not increased through the automatic operation of the stove of this invention, the stove would be caused to rapidly burn up the available fuel in a vain effort to bring the temperature of the space being heated up to the preset level, and all the while large quantities of unburned gases would be going up the flue, totally wasted.

And, automatically, the quantity of secondary air introduced into the fire chamber will be reduced again when the temperature responsive control causes the supply of so-called primary air—which determines among other things the quantity of flammable gases driven off from the burning fuel that must be burned up, if at all, through secondary combustion—to drop back once more to a lower level. This in turn avoids causing too rapid combustion of the fuel during the banked mode of operation, which would follow from an oversupply of secondary air if it were not cut back by the automatic operation of the stove.

FIG. 8 also provides a diagrammatic showing of means to turn blower fan 162 on and off—thermostat 172. Thermostat 172 may be a bimetallic, ON/OFF thermostat mounted on the interior wall of rear shroud 164 or side shroud 166. The thermostat may be designed, for example, to turn blower fan 162 on whenever the temperature of the air being heated by the stove rises to 110° F. or higher, and to turn fan 162 off when the temperature of the heated air falls to, say, 90° F. This action will mean that heated air above a selected temperature will be blown into the space to be heated, but if the fire burns low or entirely out and the temperature of the air thus falls too low, the stove will not continue to discharge the cooler air.

Use Of Subcombination Gate In Another Automatic Stove

The subcombination invention of a main air flow gate as disclosed herein can also be used in another type of stove to provide a balanced flow of so-called primary air and so-called secondary air. FIG. 9 shows diagrammatically how gate 120, for example, may be gradually and progressively moved from a maximum open to a wholly closed position (or an otherwise minimum open condition) and back again, by operation of a temperature responsive linear adjusting device such as manual bimetallic spring control 170 mounted on the interior wall of rear shroud 164 or side shroud 166 (which define the respective passageways through which air heated by the stove flows) and connected by a chain to the gate.

Device 170 may be set by the user of the stove to introduce air into the stove at a rate that it is believed will produce the desired level of heat from the stove. The operation of bimetallic spring 170 will close gate 120 if the temperature of the heated air exiting from the stove rises to a certain level, will open it wide if the temperature of the stove drops to another level, and will keep gate 120 in some position between those extremes if the temperature stays relatively stable at some intermediate figure. If it turns out that this temperature is satisfactory, bimetallic spring control 170 will be left set in the condition in which the user has placed it. If not, device 170 can be reset as required.

The advantage of using the main air flow gate of this invention as just described is that here, again, a balanced burn with an appropriate mix of so-called primary air and so-called secondary air can be automatically maintained.

Protective Doors For Viewing Window

If the temperature within fire viewing chamber 46 drops sufficiently during the banked mode of operation of the stove of this invention, there may be a tendency for creosote or other solids such as soot produced by the burning of firewood, coal or other fuel to deposit on the interior surfaces within chamber 46 and especially on viewing window 58.

Depending upon the type of fuel being burned in the stove, this deposition of creosote, soot or other solids may occur at a level of introduction of air into fire chamber 88 that produces the most efficient long term burn with an acceptable minimum production of heat. Hence it is advantageous to accept the compromise represented by the resulting condition and simply to compensate for it.

Protective doors 184 and 186 are rotatably mounted to swing into positions in which they protect window 58 when needed. The doors overlap in abutting engagement when in the position shown in FIG. 2. When the stove is in its banked mode of operation, the doors are kept in this position.

When the stove is operated in its normal burning mode or in its rapid burning mode, the doors may be swung open by handles (not shown) that extend outside viewing box 46. In these modes of operation, the protective doors occupy positions such as shown in dashed line in FIG. 2.

When protective doors 184 and 186 are in their closed positions, there is sufficient clearance at the top, bottom, and ends of the door that the secondary air has entirely adequate space to flow out of both terminal opening 118 of air transmitting channel 112 and supplementary slot 182 into the interior of viewing box 46 and from there into fire chamber 88.

Special Construction Of Coal Burning Stove

When the stove of this invention is intended to use coal as the fuel, either at all times or alternated with wood or other fuels, the fire chamber and any viewing box included in the stove must be specially constructed to accommodate the substantially higher temperatures at which coal burns. Such a mode of construction is shown in the sectional view of FIG. 13.

The construction of a stove having a viewing box when the stove is intended for use either partially or solely with coal as the fuel is different in two principal respects from a stove intended for use with firewood only. First, fire viewing box 46' of stove 30' may have a viewing window 58' that is only partially as high as window 46 in the embodiment of FIG. 2, or if desired is raised in its position. This permits bottom wall 52' and so-called secondary air transmitting channel 112' defined by that wall and inner wall 114' to slant upward and outward from the front of the stove, at an acute angle to the plane of middle level air inlet opening 47 and the plane of front wall 36 of the stove.

The stoves shown in FIGS. 1 and 13 differ, among other respects, in the height of the transparent viewing windows 58 and 58' in the respective fire viewing boxes 46 and 46'. The height of transparent viewing window 58 is seen from FIG. 1 to be approximately ½ the length of that window. Transparent viewing window 58' in FIG. 13 is approximately ½ the height of the viewing window in FIG. 1, and its height is thus approximately ¼ its length.

Inner wall 114', slanting upward and outward, provides support for a row of additional large fire bricks 98'. These fire bricks help define the front of fire chamber 88, and at the same time extend into viewing box 46' to protect the metal walls of that chamber from any piece of the very hot burning coal that might tend to fall forward out of fire chamber 88 into viewing chamber 46'.

Single protective door 188, hinged at its top, helps shield viewing window 58' from the deposit of creosote, soot or other solids on the surface thereof.

Since any piece of burning coal that may fall out into viewing chamber 46' will tend to slide down slanting fire bricks 98' back into fire chamber 88, the cubic foot volume of the fire chamber may be considered to be approximately the same for the purpose of computing the ratios, discussed above, of cross-sectional area of various air inlet openings in square inches to fire chamber volume in cubic feet.

The stove of this invention can also be used to greater or less advantage with other solid fuels—such as pressed sawdust, pressed corn cobs, other pressed biomass material, wood chips, peat, charcoal or the like—that upon heating and burning produce one or more flammable gases. The size of the charge of fuel will have to be varied with the type of fuel.

The above detailed description has been given for ease of understanding only. No unnecessary limitations should be understood therefrom, since modifications will be obvious to those skilled in the art.

We claim:

1. A stove for burning solid fuel comprised of flammable solids that produce one or more flammable gases when heated and burned, said stove having at least two modes of operation, the second mode of operation providing a lower level of combustion than the first mode, which stove comprises:

(a) a fire grate for receiving pieces of said solid fuel;

(b) a stove cabinet surrounding said grate and providing (i) a fire chamber above said grate, said fire chamber being defined by said fire grate, generally vertical side walls, and an upper wall, and (ii) an ash collecting space directly beneath said fire grate, the walls of said stove cabinet defining:

(i) a fuel access opening for depositing said pieces of solid fuel upon said grate, (ii) first, lower level air inlet means adjacent said fire grate, said first air inlet means having a finite plurality of predetermined, fixed air transmitting conditions and no other air transmitting conditions, one of said predetermined, fixed air transmitting conditions being a maximum air transmitting condition, and one being less than said maximum air transmitting condition, said air inlet means providing communication between the air surrounding said stove and said fire chamber adjacent the bottom of said chamber, (iii) second air inlet means located above said first, lower level air inlet means in a wall of the cabinet that defines said fire chamber, the path by which air flows from outside the stove through said second air inlet means into said fire chamber being entirely separate from the path by which air flows from outside said stove through said first air inlet means into said fire chamber, (iv) an exhaust outlet opening communicating with the top portion of said fire chamber, and (v) an ash removal opening communicating with said ash collecting space below the fire grate;

(c) air metering means providing communication at all times between the air surrounding said stove and said second air inlet means, said air metering means having a finite plurality of predetermined, fixed air transmitting conditions and no other air transmitting conditions, the first of said predetermined, fixed air transmitting conditions being a maximum air transmitting condition, and the second of said predetermined, fixed air transmitting conditions allowing the passage of a smaller amount of air, and when another predetermined, fixed air transmitting condition is present in said air metering means in addition to said first two conditions, such other condition allowing the passage to a still smaller amount of air, said air metering means including preselector means having a finite plurality of predetermined positions available for selection by the user of the stove, movement of said preselector means into one of its said predetermined positions selecting a corresponding one of said finite plurality of predetermined, fixed air transmitting conditions for said air metering means, said air metering means having no ohter air transmitting conditions besides said finite plurality of predetermined, fixed air transmitting conditions so long as said preselector means is placed in no other position than one of its said predetermined positions, said stove cabinet being substantially airtight except for said fuel access opening, said first, lower level air inlet means, said second air inlet means, said exhaust outlet opening and said ash removal opening, said (i) first, lower level air inlet means in its said predetermined, fixed, maximum air transmitting condition, (ii) second air inlet means, and (iii) air metering means in its said predetermined, fixed, maximum air transmitting condition taken together with said two air inlet means being of a size to introduce air into said fire chamber for said first mode of operation, said (i) first, lower level air inlet means in its said predetermined, fixed, less-than-maximum air transmitting condition, (ii) second air inlet means, and (iii) air metering means in one of its said predetermined fixed, less-than-maximum air transmitting conditions taken together with said two air inlet means being of a size to introduce air into said fire chamber for said second mode of operation;

(d) covers for:

(i) said fuel access opening, (ii) said first, lower level air inlet means, and (iii) said ash removal opening, respectively, to produce, except for any opening present when said first, lower level air inlet means is in its said predetermined, fixed less-than-maximum air transmitting condition, substantially airtight closures of said two openings and said lower level air inlet means, said fuel access opening, said first, lower level air inlet means, and said ash removal opening being selectively opened or closed independently of each other; and (e) temperature responsive control means for simultaneously placing said lower level air inlet means and said air metering means in their said respective predetermined, fixed, maximum air transmitting conditions automatially in response to a predetermined minimum temperature.

2. The stove of claim 1, which has as aforesaid at least two modes of operation, in which stove said temperature responsive control means places said lower level air inlet means in its said predetermined, fixed, less-than-maximum air transmitting condition, and said air metering means in a predetermined, fixed, less-than-maximum air transmitting condition automatically in response to a predetermined maximum temperature.

3. The stove of claim 2 in which said first, lower level air inlet means includes a plurality of air inlet openings.

4. The stove of claim 2 in which said second air inlet means includes a plurality of air inlet openings.

5. The stove of claim 2 in which said first, lower level air inlet means is located at a level entirely below said fire grate.

6. The stove of claim 2 in which:

(a) said less-than-maximum air transmitting condition of said first, lower level air inlet means is a predetermined, fixed, minimum air transmitting condition, and said air inlet means has no other air transmitting conditions;

(b) said air metering means has at least a predetermined, fixed, medium air transmitting condition which is less than its said predetermined, fixed, maximum air transmitting condition; and (c) said temperature responsive control means includes:

(i) a thermostat mounted in the space to be heated by said stove, and (ii) means controlled by said thermostat for automatically placing said first, lower level air inlet means in its said predetermined, fixed, minimum air transmitting condition and said air metering means in its said predetermined, fixed, medium air transmitting condition automatically in response to a predetermined maximum temperature in said space.

7. The stove of claim 6 in which said temperature responsive control means places said first, lower level air inlet means and said air metering means in their respective maximum air transmitting conditions automatically in response to a predetermined minimum temperature in said space.

8. The stove of claim 2 which has a third mode of operation in which the level of combustion is lower than in said second mode of operation, in which stove said first, lower level air inlet means has only said predetermined, fixed maximum air transmitting condition and said predetermined, fixed less-than-maximum air transmitting condition, and in which said air metering means has three predetermined, fixed air transmitting conditions, one of which is a maximum, one a medium, and one a minimum air transmitting condition, said air metering means including preselector means having three, and only three, predetermined settings available for selection by the user of said stove, one of said predetermined settings corresponding to said predetermined, fixed maximum air transmitting condition, the second of said predetermined settings corresponding to said predetermined, fixed medium air transmitting condition, and the third of said settings corresponding to said predetermined, fixed minimum air transmitting condition, said air metering means having no other air transmitting conditions besides said three predetermined, fixed air transmitting conditions so long as said preselector means is placed in no other position than one of its said predetermined positions, said first, lower level air inlet means in its said predetermined, fixed, less-than-maximum air transmitting condition, said second air inlet means, and said air metering means in its said predetermined, fixed medium air transmitting condition being of a size to introduce air into said fire chamber for said second mode of operation, said first, lower level air inlet means in its said predetermined, fixed, less-than-maximum air transmitting condition, said second air inlet means, and said air metering means in its said predetermined, fixed minimum air transmitting condition being of a size to introduce air into said fire chamber for said third mode of operation, and said temperature responsive control means includes a thermostat mounted in the space to be heated by said stove and means controlled by said thermostat for simultaneously placing said first, lower level air inlet means in its said closed condition and said air metering means in either its said medium air transmitting condition or in said minimum air transmitting condition, as predetermined by the user of the stove through actuation of said preselector means, automatically in response to a predetermined maximum temperature in said space.

9. The stove of claim 8 in which said temperature responsive control means includes means controlled by said thermostat for simultaneously placing said first lower level air inlet means in its said maximum air transmitting condition and said air metering means in its said maximum air transmitting condition automatically in response to a predetermined minimum temperature in said space.

10. The stove of claim 2 in which:

said less-than-maximum air transmitting condition of said first, lower level air inlet means is a minimum air transmitting condition in which the air inlet means is entirely closed, and said air inlet means has no other air transmitting conditions, said air metering means has at least a minimum air transmitting condition which is less than its said maximum air transmitting condition, and said temperature responsive control means includes a thermostat mounted in the space to be heated by said stove and means controlled by said thermostat for simultaneously placing said first, lower level air inlet means in its said closed condition and said air metering means in its said minimum air transmitting condition automatically in response to a predetermined maximum temperature in said space.

11. The stove of claim 10 in which said temperature responsive control means places said first, lower level air inlet means and said air metering means in their respective maximum air transmitting conditions automatically in response to a predetermined minimum temperature in said space.

12. The stove of claim 2:

(a) in which said air metering means has a main air inlet opening and said first, lower level air inlet means and said main air inlet opening are located adjacent to each other;

(b) which includes a single cover for said first, lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, (iii) with a first portion of said cover closing said first, lower level air inlet means, and a second portion of said cover positioned adjacent said main air inlet opening of said air metering means, when said cover is in its said closed position;

(c) in which said second portion of said cover defines a plurality of metering apertures, so that when said portion of the cover completely covers said main air inlet opening of the air metering means, a predetermined quantity of air flows into said air metering means; and (d) in which a plug is provided for all but one of said apertures defined by said second portion of said cover, each of said plugs forming a snap fit with its respective aperture, so that one or more of said apertures may be closed as predetermined by the user of the stove.

13. The stove of claim 2:

(a) in which said air metering means has a main air inlet opening and said first, lower level air inlet means and said main air inlet opening are located adjacent to each other;

(b) which includes a single cover for said first, lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, (iii) with a first portion of said cover closing said first, lower level air inlet means, and a second portion of said cover positioned adjacent said main air inlet opening of said air metering means, when said cover is in its said closed position; and (c) in which the interior surface of said cover is planar, and when said first portion of said cover completely covers said first, lower level air inlet means, the perimeter of said main air inlet opening of the air metering means is spaced from said second portion of the cover.

14. The stove of claim 13 in which the perimeter of said main air inlet opening for the air metering means lies in a plane postiioned at an acute angle to the interior surface of said hinged cover when the latter is in its said closed position with said first portion of said cover completely blocking the passage of air into said first, lower level air inlet means.

15. The stove of claim 2:

(a) in which said air metering means has a main air inlet opening and said first, lower level air inlet means and said main air inlet opening are located adjacent to each other;

(b) which includes a single cover for said first, lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, (iii) with a first portion of said cover closing said first, lower level air inlet means, and a second portion of said cover positioned adjacent said main air inlet opening of said air metering means, when said cover is in its said closed position; and (c) in which the perimeters of both said first, lower level air inlet means and said main air inlet opening of the air metering means lie in a given plane, the interior of said first portion of said cover lies in said given plane when said cover is in its said closed position, and said second portion of the cover lies at an angle of a predetermined size to said given plane when said cover is in its said closed position, so that said main air inlet opening of the air metering means remains partially open when said first, lower level air inlet means is completely closed.

16. The stove of claim 2 in which said air metering means has a main air inlet opening and closure means therefor, said closure means having a fully open condition for admitting secondary air for said first mode of operation of the stove, and a partially open condition for admitting secondary air in a first predetermined amount for at least one other mode of operation of said stove.

17. The stove of claim 16 in which said air metering means (a) has three predetermined, fixed air transmitting conditions, one of which is a maximum, one a medium, and one a minimum air transmitting condition, and no other air transmitting conditions, and (b) includes means defining at least one supplementary air inlet opening through which air passes, when said air metering means is in its said medium air transmitting condition for said second mode of operation of the stove, to supplement the secondary air admitted into said fire chamber through said main air inlet opening of the air metering means when said closure means for said main air inlet opening is in its said partially open condition.

18. The stove of claim 17 which includes means to selectively close said at least one supplementary air inlet opening for secondary air, to place said air metering means in its said predetermined, fixed, minimum air transmitting condition for a third mode of operation in which the level of combustion is lower than in said second mode of operation.

19. The stove of claim 16 in which said air metering means includes a passageway for secondary air that is in communication with said fire chamber through said second air inlet means at one end and in communication with the air surrounding said stove at the other, and a wall of said passageway defines at least one aperture through which secondary air flows in a second predetermined amount in addition to secondary air that flows into said air metering means in said first predetermined amount when said closure means is in its partially open position with respect to the main inlet opening of said air metering means.

20. The stove of claim 19 which includes means to close said at least one additional secondary air inlet aperture when desired.

21. The stove of claim 20 in which said last mentioned means is a hinged gate movable between a position in which it closes said at least one additional secondary air inlet aperture and a position in which it leaves said apertures fully open.

22. The stove of claim 21 in which said gate is manually operable, to permit the user of the stove to preselect a condition in which said gate closes off said at least one additional secondary air inlet aperture or leaves the same fully open, as desired.

23. The stove of claim 2 for use primarily with coal as the fuel in which said first, lower level air inlet means in its less-than-maximum air transmitting condition is not completely closed, but admits some quantity of air for a mode of operation providing a lower level of combustion than said first mode of operation, said quantity of air being substantially less than the quantity of air admitted by said air metering means during any mode of operation at a level of combustion lower than the level in said first mode of operation.

24. The stove of claim 2 for use primarily with coal as the fuel in which:

(a) said air metering means has a main air inlet opening and said first, lower level air inlet means and said main air inlet opening are located adjacent to each other, so that said two means can be readily put in their respective predetermined, fixed, maximum air transmitting conditions simultaneously, and can likewise be readily put in their respective predetermined, fixed, less-than-maximum air transmitting conditions simultaneously, by actuation of a single mechanical means;

(b) a single cover is provided for said first lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, and (iii) with a first portion of said cover closing said first, lower level air inlet means, and a second portion of said cover positioned adjacent said main air inlet opening of said air metering means, when said cover is in its said closed position; and (c) said first cover portion for closing said first, lower level air inlet means defines at least one metering aperture, so that when said cover portion completely covers said first, lower level air inlet means, a predetermined quantity of air flows through said at least one metering aperture into said air inlet means.

25. The stove of claim 2 for use primarily with coal as the fuel:

(a) in which said air metering means has a main air inlet opening and said first, lower level air inlet means and said main air inlet opening are located adjacent to each other;

(b) which includes a single cover for said first, lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, (iii) with a first portion of said cover closing said first, lower level air inlet means, and a second portion of said cover positioned adjacent said main air inlet opening of said air metering means, when said cover is in its said closed position; and (c) in which a stop member extends laterally from the wall of one of the air transmitting passages leading to said fire chamber from said first, lower level air inlet means and said main air inlet opening of the air metering means, and a set screw is carried by one of said hinge cover and said stop member to impinge on the other of said members and thereby hold said hinge cover in a predetermined, partially open position for any mode of operation of the stove in which the level of combustion is less than in said first mode of operation.

26. The stove of claim 25 in which said laterally extending stop member is a lug.

27. The stove of claim 25 in which said laterally extending stop member is a plunger extending from a relay operated by an electric switch for selection of a predetermined mode of operation of the stove.

28. The stove of claim 2 in which said stove cabinet includes a fire viewing box, said viewing box having a bottom wall, two end walls, a top wall, a front wall, and a planar, transparent viewing window as a part of said front wall through which window the fuel burning within said stove can be observed, said viewing box walls and window defining a fire viewing chamber extending forward from the front wall of said fire chamber and communicating with said fire chamber through said second air inlet means, which stove is primarily for use with coal as the fuel, said bottom wall of said viewing box slanting upward and outward from the front wall of the stove cabinet, with the bottom edge of said viewing window positioned above the bottom of said second air inlet means and said fire grate extending upward to the vicinity of said bottom edge of the fire viewing window.

29. The stove of claim 2 in which, in said first mode of operation of said stove:

said first, lower level air inlet means in its said predetermined, fixed maximum air transmitting condition provides a passage for unassisted air flow having an effective cross sectional area between about 0.6 sq. in. and about 1.1 sq. in. for every cubic foot of volume of said fire chamber, and the equivalent thereof if said air flow is assisted, and said air metering means in its said predetermined, fixed maximum air transmitting condition provides a passage for unassisted air flow having an effective cross sectional area between about 1.0 sq. in and about 1.35 sq. in for every cubic foot of volume of said fire chamber, and the equivalent thereof if said air flow is assisted.

30. The stove of claim 29 in which, in said first mode of operation of said stove:

said first, lower level air inlet means in its said predetermined, fixed maximum air transmitting condtition provides a passage for unassisted air flow having an effective cross sectional area between about 0.75 sq. in. and about 1.0 sq. in. for every cubic foot of volume of said fire chamber, and the equivalent thereof if said air flow is assisted, and said air metering means in its said predetermined, fixed maximum air transmitting condition provides a passage for unassisted air flow that has an effective cross sectional area between about 1.17 sq. in. and about 1.3 sq. in. for every cubic foot of volume of said fire chamber, and the equivalent thereof if said air flow is assisted.

31. The stove of claim 29 in which, in said first mode of operation of said stove:

said first, lower level air inlet means in its said predetermined, fixed maximum air transmitting condition provides a passage for unassisted air flow having an effective cross sectional area of about 0.9 sq. in. for every cubic foot of volume of said fire chamber, and the equivalent thereof if said air flow is assisted, and said air metering means in its said predetermined, fixed maximum air transmitting condition provides a passage for unassisted air flow having an effective cross sectional area of about 1.25 sq. in. for every cubic foot of volume of said fire chamber, and the equivalent thereof if said air flow is assisted.

32. The stove of claim 2 in which:

said predetermined, fixed minimum air transmitting condition of said first, lower level air inlet means is a substantially closed condition, said second air transmitting condition of said air metering means is a medium air transmitting condition in which a passage is provided for unassisted air flow that has an effective cross sectional area between about 0.5 sq. in. and about 0.65 sq. in. for every cubic foot of volume of said fire chamber, and the equivalent thereof if said air flow is assisted, and said second air inlet means and said air metering means in its said predetermined, fixed medium air transmitting condition, with said first, lower level air inlet means substantially closed, introduces air into said fire chamber for said second mode of operation of said stove.

33. The stove of claim 32 in which said air metering means in its said predetermined, fixed medium air transmitting condition provides a passage for unassisted air flow that has an effective cross sectional area between about 0.55 sq. in. and about 0.63 sq. in. for every cubic foot of volume of said fire chamber, and the equivalent thereof if said air flow is assisted, for said second mode of operation of said stove.

34. The stove of claim 32 in which said air metering means in its said predetermined, fixed medium air transmitting condition provides a passage for unassisted air flow that has an effective cross sectional area of about 0.6 sq. in. for every cubic foot of volume of said fire chamber, and the equivalent thereof if said air flow is assisted, for said second mode of operation of said stove.

35. The stove of claim 2 in which:

said predetermined, fixed minimum air transmitting condition of said first, lower level air inlet means is a substantially closed condition, one of said air transmitting conditions of said air metering means is a minimum air transmitting condition in which a passage is provided for unassisted air flow that has an effective cross sectional area between about 0.3 sq. in. and about 0.5 sq. in. for every cubic foot of volume of said fire chamber, and the equivalent thereof if said air flow is assisted, and said second air inlet means and said air metering means in its said predetermined, fixed minimum air transmitting condition, with said first, lower level air inlet means substantially closed, introduces air into said fire chamber for said third mode of operation of said stove.

36. The stove of claim 35 in which said air metering means in its said predetermined, fixed minimum air transmitting condition provides a passage for unassisted air flow that has an effective cross sectional area between about 0.35 sq. in, and about 0.45 sq. in. for every cubic foot of volume of said fire chamber, and the equivalent thereof if said air flow is assisted, for said second mode of operation of said stove.

37. The stove of claim 35 in which said air metering means in its said predetermined, fixed minimum air transmitting condition provides a passage for unassisted air flow that has an effective cross sectional area of about 0.4 sq. in. for every cubic foot of volume of said fire chamber, and the equivalent thereof if said air flow is assisted, for said second mode of operation of said stove.

38. The stove of claim 2 primarily for use with coal as the fuel in which:

said first, lower level air inlet means in its said predetermined, fixed, less-than-maximum air transmitting condition provides a passage for unassisted air flow that has an effective cross sectional area between about 0.04 sq. in. and about 0.16 sq. in. for every cubic foot of volume of said fire chamber, and the equivalent thereof if said air flow is assisted, said second air transmitting condition of said air metering means is a medium air transmitting condition in which a passage is provided for unassisted air flow that has an effective cross sectional area between about 0.5 sq. in. and about 0.65 sq. in. for every cubic foot of volume of said fire chamber, and the equivalent thereof if said air flow is assisted, and said first, lower level air inlet means in its said predetermined, fixed, less-than-maximum air transmitting condition, said second air inlet means and said air metering means in its said predetermined, fixed medium air transmitting condition introduce air into said fire chamber for said second mode of operation of said stove.

39. The stove of claim 38 in which, in said second mode of operation of said stove:

said first, lower level air inlet means in its said predetermined, fixed less-than-maximum air transmitting condition provides a passage for unassisted air flow that has an effective cross sectional area between about 0.06 sq. in. and about 0.12 sq. in. for every cubic foot of volume of said fire chamber, and the equivalent thereof if said air flow is assisted, and said air metering means in its said predetermined, fixed medium air transmitting condition provides a passage for unassisted air flow that has an effective cross sectional area between about 0.55 sq. in. and about 0.63 sq. in. for every cubic foot of volume of said fire chamber, and the equivalent thereof if said air flow is assisted.

40. The stove of claim 38 in which, in said second mode of operation of said stove:

said first, lower level air inlet means in its said predetermined, fixed less-than-maximum air transmitting condition provides a passage for unassisted air flow that has an effective cross sectional area of about 0.08 sq. in. for every cubic foot of volume of said fire chamber, and the equivalent thereof if said air flow is assisted, and said air metering means in its said predetermined, fixed medium air transmitting condition provides a passage for unassisted air flow that has an effective cross sectional area of about 0.6 sq. in. for every cubic foot of volume of said fire chamber, and the equivalent thereof if said air flow is assisted.

41. The stove of claim 2 primarily for use with coal as the fuel which has a third mode of operation and in which:

said first, lower level air inlet means in its said predetermined, fixed, less-than-maximum air transmitting condition provides a passage for unassisted air flow that has an effective cross sectional area between about 0.4 sq. in. and about 0.16 sq. in. for every cubic foot of volume of said fire chamber, and the equivalent thereof if said air flow is assisted, said air metering means has a third predetermined, fixed air transmitting condition, which is a minimum air transmitting condition, in which a passage is provided for unassisted air flow that has an effective cross sectional area between about 0.3 sq. in. and about 0.5 sq. in. for every cubic foot of volume of said fire chamber, and the equivalent thereof if said air flow is assisted, and said first, lower level air inlet means in its said predetermined, fixed, less-than-maximum air transmitting condition, said second air inlet means and said air metering means in its said predetermined, fixed, minimum air transmitting condition introduce air into said fire chamber for said third mode of operation of said stove.

42. The stove of claim 41 in which, in said third mode of operation of said stove:

said first, lower level air inlet means in its said predetermined, fixed, less-than-maximum air transmitting condition provides a passage for unassisted air flow that has an effective cross sectional area between about 0.6 sq. in. and about 0.12 sq. in. for every cubic foot of volume of said fire chamber, and the equivalent thereof if said air flow is assisted, and said air metering means in its said predetermined, fixed minimum air transmitting condition provides a passage for unassisted air flow that has an effective cross sectional area between about 0.35 sq. in and about 0.45 sq. in. for every cubic foot of volume of said fire chamber, and the equivalent thereof if said air flow is assisted.

43. The stove of claim 41 in which, in said third mode of operation of said stove:

said first, lower level air inlet means in its said predetermined, fixed minimum air transmitting condition provides a passage for unassisted air flow that has an effective cross sectional area of about 0.08 sq. in. for every cubic foot of volume of said fire chamber, and the equivalent thereof if said air flow is assisted, and said air metering means in its said predetermined, fixed minimum air transmitting condition provides a passage for unassisted air flow that has an effective cross sectional area of about 0.4 sq. in. for every cubic foot of volume of said fire chamber, and the equivalent thereof if said air flow is assisted.

44. The stove of claim 28 in which the height of said transparent viewing window is about $\frac{1}{4}$ the length of said window.

45. The stove of claim 2 in which:

(a) said air metering means has a main air inlet opening and said first, lower level air inlet means and said main air inlet opening are located adjacent to each other, so that said two means can be readily put in their respective predetermined, fixed, maximum air transmitting conditions simultaneously, and can likewise be readily put in their respective predetermined, fixed, less-than-maximum air transmitting conditions simultaneously, by actuation of a single mechanical means;

(b) a single cover is provided for said first, lower level air inlet means and said main air inlet opening of the air metering means in the form of an air flow gate hinged (i) to pivot from a fully open position to a predetermined closed position and vice versa, stopping only at said two positions and at no others, and (ii) to move toward said air inlet means and said main air inlet opening simultaneously, and away from said air inlet means and said main air inlet opening simultaneously, and (iii) with a first portion of said cover closing said first, lower level air inlet means, and a second portion of said cover positioned adjacent said main air inlet opening of said air metering means, when said cover is in its said closed position; and (c) means is provided to keep said main air inlet opening of the air metering means partially open when said first, lower level air inlet means is entirely closed.

46. The stove of claim 2 in which said air metering means has a main air inlet opening and an air transmitting passageway leading from said main air inlet opening to said second air inlet means into said fire chamber, said passageway extending from back to front of said stove under said fire chamber, said air transmitting passageway lying in close proximity to said fire chamber both under and in front of the same.

47. The stove of claim 46 in which the length of said air transmitting passageway leading from said main air inlet opening of said air metering means to said second air inlet means is several times longer than the air transmitting passageway from said first, lower level air inlet means to said fire chamber.

48. The stove of claim 47 in which said first mentioned air transmitting passageway is more than three times as long as second mentioned air transmitting passageway.

49. The stove of claim 2 in which:

(a) said less-than-maximum air transmitting condition of said first, lower level air inlet means is a predetermined, fixed, minimum air transmitting condition, and said air inlet means has no other air transmitting conditions;

(b) said air metering means has at least a predetermined, fixed, medium air transmitting condition which is less than its said predetermined, fixed, maximum air transmitting condition; and (c) said temperature responsive control means includes:

(i) a thermostat mounted in the air passageway through which heated air exits from said stove, and (ii) means controlled by said thermostat for automatically placing said first, lower level air inlet means in its said predetermined, fixed, minimum air transmitting condition and said air metering means in its said predetermined, fixed, medium air transmitting condition automatically in response to a predetermined maximum temperature in said heated air passageway.

* * * * *